US011359422B2

(12) United States Patent
Arlinghaus et al.

(10) Patent No.: US 11,359,422 B2
(45) Date of Patent: Jun. 14, 2022

(54) ADJUSTABLE DEAD-LATCHING BOLT MECHANISMS

(71) Applicant: Schlage Lock Company LLC, Carmel, IN (US)

(72) Inventors: Paul R. Arlinghaus, Fishers, IN (US); Mohammed Maksood Ali, Bangalore (IN); Jonah M. Pattar, Bangalore (IN); Kemparaju Putaswamy, Bangalore (IN); Sushanth Anand Rao Kondi, Bangalore (IN); Matthew S. Graham, Noblesville, IN (US); Subashchandra Rai, Bangalore (IN); Keshav Tantri, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 253 days.

(21) Appl. No.: 16/596,355

(22) Filed: Oct. 8, 2019

(65) Prior Publication Data

US 2020/0109581 A1 Apr. 9, 2020

Related U.S. Application Data

(62) Division of application No. 15/002,296, filed on Jan. 20, 2016, now Pat. No. 10,435,927.
(Continued)

(51) Int. Cl.
*E05C 9/04* (2006.01)
*E05B 63/00* (2006.01)
(Continued)

(52) U.S. Cl.
CPC ..... *E05C 9/04* (2013.01); *E05B 63/0056* (2013.01); *E05B 65/1006* (2013.01);
(Continued)

(58) Field of Classification Search
CPC ... E05C 9/04; E05C 9/185; E05C 9/02; E05C 9/042; E05C 9/043; E05B 63/0056;
(Continued)

(56) References Cited

U.S. PATENT DOCUMENTS 1,071,656 A * 8/1913 Voight ..... E05B 63/20 292/333
1,203,115 A 10/1916 Hurd
(Continued)

OTHER PUBLICATIONS

International Search Report; International Searching Authority; US Patent and Trademark Office; International Application No. PCT/US2016/014188; dated Jun. 24, 2016; 4 pages.
(Continued)

*Primary Examiner* — Christine M Mills
*Assistant Examiner* — Faria F Ahmad
(74) *Attorney, Agent, or Firm* — Taft Stettinius & Hollister LLP

(57) ABSTRACT

Latch mechanisms adapted to prevent unauthorized displacement of a latch bolt from an extended, locked position to a retracted, unlocked position. The latch mechanisms prevent the failure of a latch bolt of one latch mechanism to return to an extended lock position from interfering with the ability of a latch bolt of an inter-related latch mechanism from being able to return to an extended, locked position. Further embodiments provide a mounting bracket mounted to a door to allow the associated latch mechanism to be indirectly secured to the door. Additionally, the mounting bracket may have a plurality of mounting orifices that allow the mounting bracket to be used with a wide range of latch mechanisms, as well as provide adjustable attachment of the latch mechanism to the mounting bracket.

20 Claims, 18 Drawing Sheets

Related U.S. Application Data

(60) Provisional application No. 62/105,312, filed on Jan. 20, 2015.

(51) Int. Cl.
*E05B 65/10* (2006.01)
*E05C 9/18* (2006.01)
*E05C 9/02* (2006.01)
*E05B 17/20* (2006.01)

(52) U.S. Cl.
CPC ..... *E05C 9/185* (2013.01); *E05B 17/2034* (2013.01); *E05C 9/02* (2013.01); *E05C 9/042* (2013.01); *E05C 9/043* (2013.01); *Y10T 292/08* (2015.04); *Y10T 292/0801* (2015.04); *Y10T 292/0834* (2015.04); *Y10T 292/0836* (2015.04); *Y10T 292/1016* (2015.04); *Y10T 292/54* (2015.04); *Y10T 292/546* (2015.04)

(58) Field of Classification Search
CPC ..... E05B 65/1006; E05B 17/2034; Y10T 292/08; Y10T 292/0801; Y10T 292/0834; Y10T 292/0836; Y10T 292/54; Y10T 292/546; Y10T 292/1016
See application file for complete search history.

(56) References Cited

U.S. PATENT DOCUMENTS 1,203,116 A 10/1916 Hurd
1,282,320 A 10/1918 Timlin et al.
1,282,787 A 10/1918 Evans
1,324,181 A * 12/1919 Smith ..... E05B 63/20 292/336
1,338,713 A 5/1920 Toney
1,677,271 A 7/1928 Carroll
1,708,078 A 4/1929 Bolles
1,721,489 A 7/1929 Prinzler
2,079,895 A 5/1937 Brooks
2,202,916 A 6/1940 Mussa
2,535,947 A 12/1950 Newell
2,752,773 A 7/1956 Abelson et al.
2,762,642 A 9/1956 Jewett
2,836,451 A 5/1958 Clifton, Jr.
2,887,336 A 5/1959 Meyer
3,029,096 A 4/1962 Welch
3,083,560 A 4/1963 Scott
3,097,007 A 7/1963 Eichacker et al.
3,123,387 A 3/1964 Jackson et al.
3,124,378 A 3/1964 Jackson
3,214,947 A 11/1965 Wikkerink
3,319,986 A 5/1967 Balducci
3,455,591 A 7/1969 Powers
3,563,585 A 2/1971 Welch
3,582,122 A 6/1971 Foster
3,776,582 A 12/1973 Balducci
3,788,687 A * 1/1974 Zawadzki ..... E05B 63/20 292/92
4,099,753 A 7/1978 Gwozdz et al.
4,218,903 A * 8/1980 Eads ..... E05B 59/00 292/200
4,283,882 A * 8/1981 Hubbard ..... E05B 63/20 292/18
4,368,905 A 1/1983 Hirschbein
4,418,949 A * 12/1983 Horgan, Jr. ..... E05B 65/106 292/336.3
4,796,931 A 1/1989 Heid
4,819,976 A 4/1989 Bert
4,875,722 A * 10/1989 Miller ..... E05B 65/1073 292/92
4,921,290 A 5/1990 Dietrich
4,961,330 A 10/1990 Evans
4,974,890 A 12/1990 Cohrs
5,022,691 A 6/1991 Clay, Jr.
5,114,192 A 5/1992 Toledo et al.
5,177,988 A 1/1993 Bushnell
5,464,259 A 11/1995 Cohrs et al.
5,566,991 A 10/1996 Young
5,603,534 A 2/1997 Fuller
5,605,362 A 2/1997 Surko, Jr.
5,673,949 A 10/1997 Mader et al.
5,702,134 A 12/1997 Hsieh
5,762,385 A 6/1998 Mader et al.
5,816,017 A 10/1998 Hunt et al.
5,931,515 A 8/1999 Stendal
6,185,773 B1 2/2001 Goedde
6,217,087 B1 4/2001 Fuller
6,409,231 B1 6/2002 Rusiana
6,641,183 B2 11/2003 Brown
7,287,784 B2 10/2007 Lin
7,712,799 B2 5/2010 Peng
7,849,718 B2 * 12/2010 Ambrass ..... E05B 1/0015 70/92
7,887,107 B2 2/2011 Shen
8,011,702 B2 * 9/2011 Tien ..... E05B 65/1006 292/336.3
8,146,962 B2 * 4/2012 Lu ..... E05B 65/104 292/93
8,267,441 B2 * 9/2012 Lin ..... E05B 53/00 292/92
8,382,166 B2 2/2013 Hagemeyer et al.
8,550,507 B2 10/2013 Barton et al.
8,556,306 B1 10/2013 Lin
8,562,032 B1 10/2013 Lin
8,702,132 B2 4/2014 Tien
8,979,140 B2 3/2015 Tien
9,151,093 B2 10/2015 Lin
9,567,782 B2 2/2017 Raatikainen
9,656,697 B2 5/2017 Puscas et al.
10,081,967 B2 9/2018 Graham
10,094,142 B2 10/2018 Kondi et al.
2003/0057714 A1 3/2003 Brown
2008/0034818 A1 2/2008 Vinadio
2008/0141740 A1 6/2008 Shvartz
2008/0143121 A1 6/2008 Blasen
2008/0156048 A1 7/2008 Topfer
2008/0156049 A1 7/2008 Topfer
2009/0194999 A1 8/2009 Shen
2010/0066101 A1 3/2010 Shen
2010/0066102 A1 * 3/2010 Shen ..... E05B 65/1006 292/92
2010/0109349 A1 5/2010 Peabody et al.
2010/0117376 A1 5/2010 Shen
2010/0259052 A1 10/2010 Lin
2011/0192089 A1 8/2011 Barton et al.
2011/0198869 A1 8/2011 Lu et al.
2011/0198871 A1 8/2011 Lu et al.
2011/0309641 A1 12/2011 Raatikainen
2013/0093195 A1 4/2013 Tien
2013/0106119 A1 5/2013 Stendal
2013/0127184 A1 5/2013 Tien
2013/0154283 A1 6/2013 Arlinghaus et al.
2014/0265355 A1 9/2014 Tien
2016/0153218 A1 6/2016 Kondi et al.
2016/0298367 A1 10/2016 Dintheer
2016/0368543 A1 12/2016 Puscas et al.
2016/0376816 A1 12/2016 Graham
2017/0191288 A1 7/2017 Lin

OTHER PUBLICATIONS

Written Opinion; International Searching Authority; US Patent and Trademark Office; International Application No. PCT/US2016/014188; dated Jun. 24, 2016; 6 pages.
International Preliminary Report on Patentability; International Bureau of WIPO; International Application No. PCT/US2016/014188; dated Jul. 25, 2017; 7 pages.
Canadian Office Action; Canadian Intellectual Property Office; Canadian Application No. 2,974,363; dated Jun. 14, 2018; 3 pages.
Canadian Office Action; Canadian Intellectual Property Office;

(56) References Cited

OTHER PUBLICATIONS

Canadian Patent Application No. 3,052,571; dated Oct. 1, 2020; 4 pages.

* cited by examiner

ADJUSTABLE DEAD-LATCHING BOLT MECHANISMS

CROSS-REFERENCE TO RELATED APPLICATIONS

This application is a divisional of U.S. patent application Ser. No. 15/002,296 filed on Jan. 20, 2016 and issued as U.S. Pat. No. 10,435,927, which claims the benefit of U.S. Provisional Application No. 62/105,312 filed on Jan. 20, 2015, the contents of each application hereby incorporated herein by reference in their entirety.

BACKGROUND

Exit devices, including vertical rod exit devices, often have a latch device that extends into, and out of, the top and bottom edges of a door. Typically, the latch device is configured to extend away from the door and into a mating recess in a door frame so as to provide a locking engagement that may maintain the door in a closed position. The latch device may also be connected to a push bar or trim by a rod or cable. When the door is to be displaced, the push bar or trim is displaced, which may cause the rod or cable to provide a pushing or pulling force that retracts the latch device from the mating recess in the adjacent structure.

Operation of exit devices often requires that the latch device extend a sufficient distance into the mating recess so that the latch device attains a locked position within the mating recess. The extent to which the latch device is to operably extend away from the door and into a mating recess may differ for different doors and/or different door frames. For example, differences in door heights and/or the depths of mating recesses may alter the distance that the latch device is to extend into the mating recess to reach the locked position. Further, over time, the position of the door relative to the door frame may change. Such changes, which may be due, for example, to door sag and general wear and tear on the door, may also alter the degree to which the latch device is to extend into the mating recess.

The door installer often determines the extended position of the latch device before the door is installed, such as, for example, before the door is hung to the door frame. Thus, for ease of installation, the degree to which the latch device will at least initially extend away from the door is typically initially set while the door is laying in a horizontal orientation. Yet, the actual degree of the extension of the latch device typically is not known until after the door has been hung to the door frame. Further, for at least one type of latch device, the extent to which the latch device extends from the door is at least initially positioned by inserting a pin through one of a plurality of holes in a housing that is mounted to the door, and into a hole of the latch device. Such positioning of the pin often involves the installer trying to feel whether the pin has passed through one of the holes of the housing and into the hole of the latch device. When the degree of extension of the latch device is to be adjusted, the pin is removed from the hole of the latch device and the hole of the housing, and placed, again by feel, into another hole in the housing before being reinserted into the hole of the pin. Thus, the degree that the latch device may be adjusted or trimmed is generally limited to the number and positioning of the holes in the housing.

Further, such adjustments to the degree that the latch device extends from the door generally occur along the same axis as the latch device travels into and out of the mating recess. Yet, reliance on the same axis for these adjustments may preclude the latch device from providing dead-latching capabilities. Further, the absence of dead-latching capabilities may increase the opportunity for unauthorized displacement of the latch device and the resulting unauthorized unlocking of the exit device and/or displacement of the associated door to an open position. For example, the absence of dead-locking capabilities may allow for the latch device to be forcibly retracted by an item, such as, for example, by tools, fingers, or cards, among other items, that engage the latch device through a door gap.

BRIEF SUMMARY

An aspect of the present invention is directed to an apparatus that includes a displacement rod having a rod protrusion and an aperture, the displacement rod being adapted for displacement between a first rod position and a second rod position. The apparatus further includes a lever member that is pivotally coupled to the displacement rod, the lever member having an abutment member and a foot portion. The abutment member extends from the lever member toward the displacement rod. Additionally, the rod protrusion is structured to engage the abutment member to pivotally displace the lever member from a first position to a second position as the displacement rod is displaced from the first rod position to the second rod position. The apparatus further includes a latch bolt having a bolt protrusion, at least a portion of the latch bolt being structured for slideable insertion into the aperture. Further, the foot portion is structured to impede the displacement of at least the bolt protrusion from an extended position to a retracted position when the lever member is in the first position.

Another aspect of the present invention is directed to an apparatus that includes a displacement rod that is structured for displacement between a retracted rod position and an extended rod position. The apparatus also includes at least one first link that has a first end and a link slot. The first end of the at least one first link is pivotally coupled to the displacement rod by a first link pin. Additionally, the apparatus includes at least one second link that has a first end and a second end. The first end of the at least one second link is pivotally coupled to the at least one first link by a second link pin that extends into the link slot. The apparatus further includes a latch bolt that has a first latch slot and a second latch slot, the first latch slot being structured to receive insertion of a latch pin, the second latch slot being adapted to receive a static latch pin. Additionally, the latch bolt is structured for displacement between an extended position and a retracted position.

Another aspect of the present invention is directed to an apparatus that includes a displacement rod that is structure for displacement between a retracted rod position and an extended rod position. The apparatus further includes a link that is coupled to the displacement rod by at least one link pin, the link having a cam opening having a cam surface. The cam opening is configured to receive the placement of at least a portion of a cam pin, while the cam surface is adapted to facilitate the displacement of the cam pin in a first direction when the cam pin abuts the cam surface. The apparatus also includes a latch bolt having a latch slot, the latch slot being sized to receive the slideable insertion of the cam pin. Additionally, the latch slot extends along an axis that is offset from, and not perpendicular to, a longitudinal axis of a body portion of the latch bolt.

Other aspects of the present invention will become apparent by consideration of the detailed description and accompanying drawings.

Figure 1:
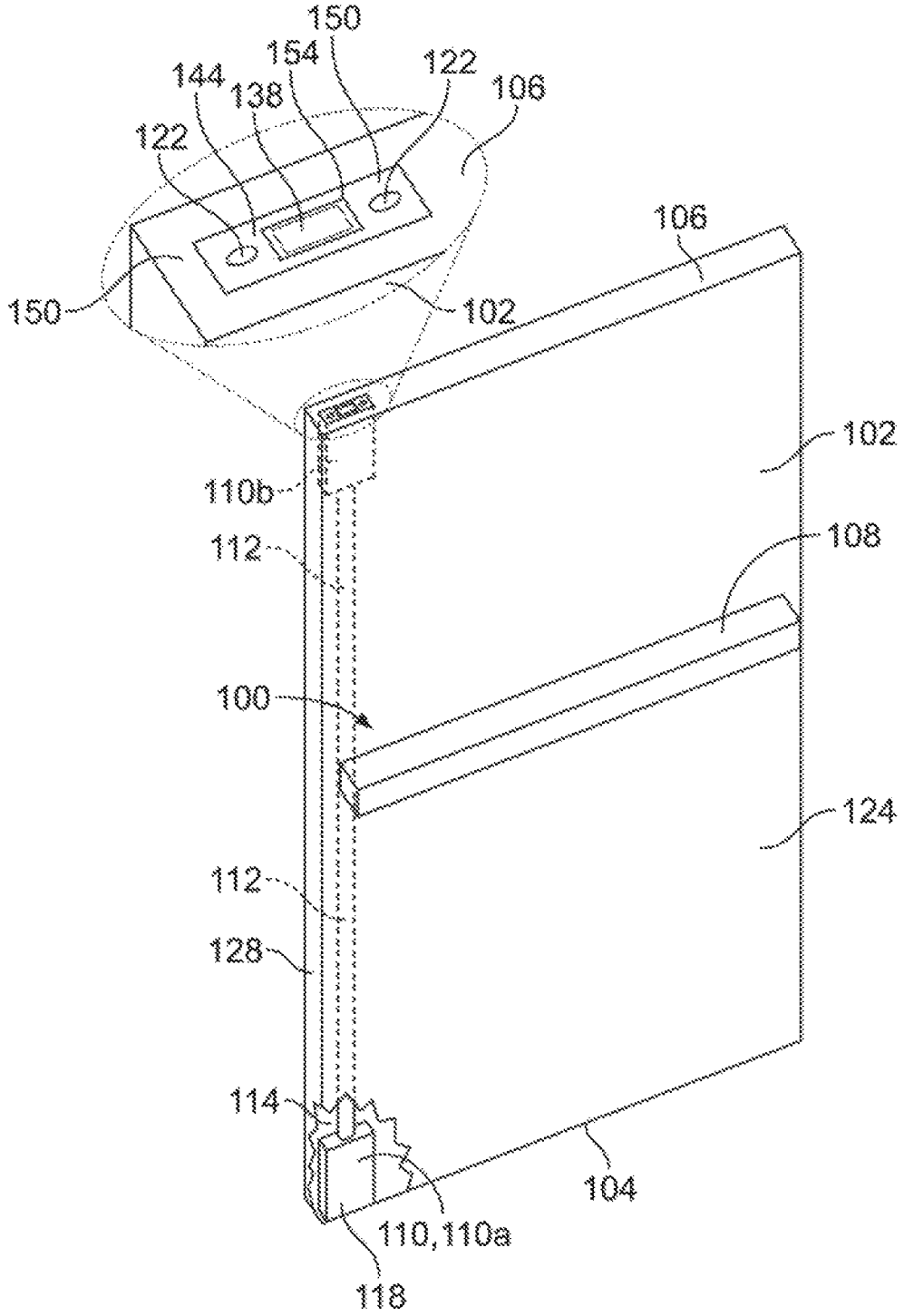
FIG. 1 illustrates a front view of an exit device that is attached to a door.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DESCRIPTION OF THE ILLUSTRATED EMBODIMENTS

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof. Additionally, while embodiments of inventions are discussed below with respect to exit devices, the inventions can also be utilized with, or for, other entryway control devices or applications, including for example, but not limited to, multi-point locks.

FIG. 1 illustrates a front view of an exit device 100 that is attached to a door 102. The door 102 includes at least two edges at opposing sides of the door 102, such as, for example, a first edge 104 and a second edge 106. As shown, according to certain embodiments, the exit device 100 may include a push bar or trim 108 that is operably connected to at least one latch mechanism 110 by one or more rods or cables 112. In the illustrated embodiment, the exit device 100 includes a first latch mechanism 110*a* positioned at, or adjacent to, the first edge 104, and a second latch mechanism 110*b* positioned at, or adjacent to, the second edge 106. However, it is contemplated that the number, as well as the positioning of latch mechanisms 110, may vary for different doors or door configurations. For example, according to certain embodiments, the exit device 100 may include only a first latch mechanism 110*a* that is positioned along the first edge 104, with the first edge 104 corresponding to the top edge 106 or the bottom edge 104 of the door 102.

According to certain embodiments, one or more latch mechanisms 110 may be positioned in a cavity 114 in the door 102. The cavity 114 may have a variety of different shapes and sizes. For example, according to certain embodiments, the cavity 114 may have a first portion that is configured to receive at least a portion of the latch mechanism 110, such as, for example, an outer housing 118 of the latch mechanism 110, and a second portion that is sized to receive placement of the rod or cable 112. Further, as shown in FIG. 1, according to certain embodiments, the latch mechanism 110 may be secured to the door 102 through the use of one or more fasteners 122, such as, for example, screws, bolts, or pins, among other fasteners. Alternatively, rather than being positioned within the door 102, according to other embodiments, the latch mechanism 110 and/or rod or cable 112 may be positioned along an outer, exterior surface 124 of the door 102.

According to certain embodiments, at least when the door 102 is in a closed position, one or more edges of the door 102 may be in relatively close proximity to an adjacent surface or structure, such as, for example, a door frame, wall, or floor, among other surfaces or structures. For example, in the illustrated embodiment, with the door 102 in a closed position, a third edge 128 of the door 102 that is generally perpendicular to the first and second edges 104, 106, may be adjacent to a side portion of a door frame, while the first edge 104 may be adjacent to a bottom portion of the door frame or the floor. In the illustrated embodiment, the bottom portion of the door frame or the floor may include at least a portion of a recess that is configured to receive the removable insertion of a latch bolt from the first latch mechanism 110*a*. Similarly according to certain embodiments that include the second latch mechanism 110*b* in addition to, or in lieu of, the first latch mechanism 110*a*, a latch bolt from the second latch mechanism 110*b* may extend away from the second edge 106 and into an adjacent recess positioned in at least an upper portion of the door frame or an adjacent wall. Optionally, according to certain embodiments, in addition to, or in lieu of the first and/or second latch mechanisms 110*a*, 110*b*, the exit device 100 may include at least a third latch mechanism positioned at, or adjacent to, the third edge 128 of the door 102, and which extends into a recess in the side portion of the door frame.

According to certain embodiments, the outer housing 118 may be operably connected to one or more extensions 150 that are configured to extend about a first end 144 of the outer housing 118 and along an adjacent edge, or a recess in an edge, of the door 102, such as, for example, along the first or second edges 104, 106 or a recess in the first edge 104 or second edge 106. Further, the one or more extensions 150 may include an aperture that is configured to receive the insertion of one or more fasteners 122 that secure the latch mechanism 110*b* to the door 102, as previously discussed. The first end 144 may also include an opening 154 that is configured to allow the slideable displacement of at least a portion of the latch bolt 138 into, and out of, at least the inner region of the outer housing 118.

Figure 3:
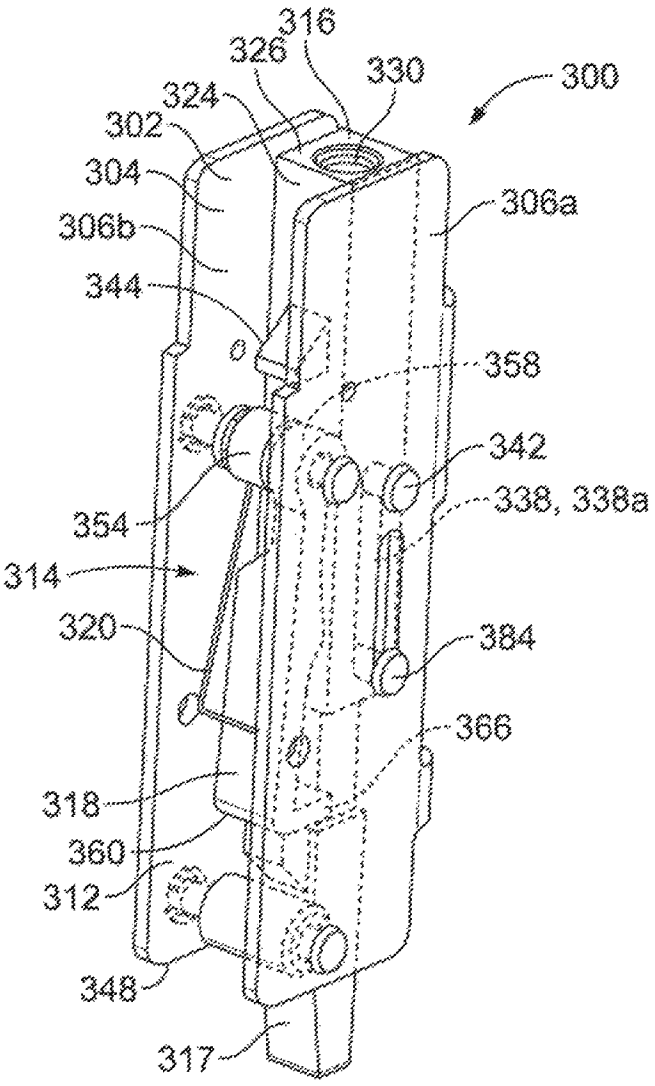
FIG. 3 illustrates a side perspective partial phantom view of the latch mechanism shown in FIG. 2.
Figure 2:
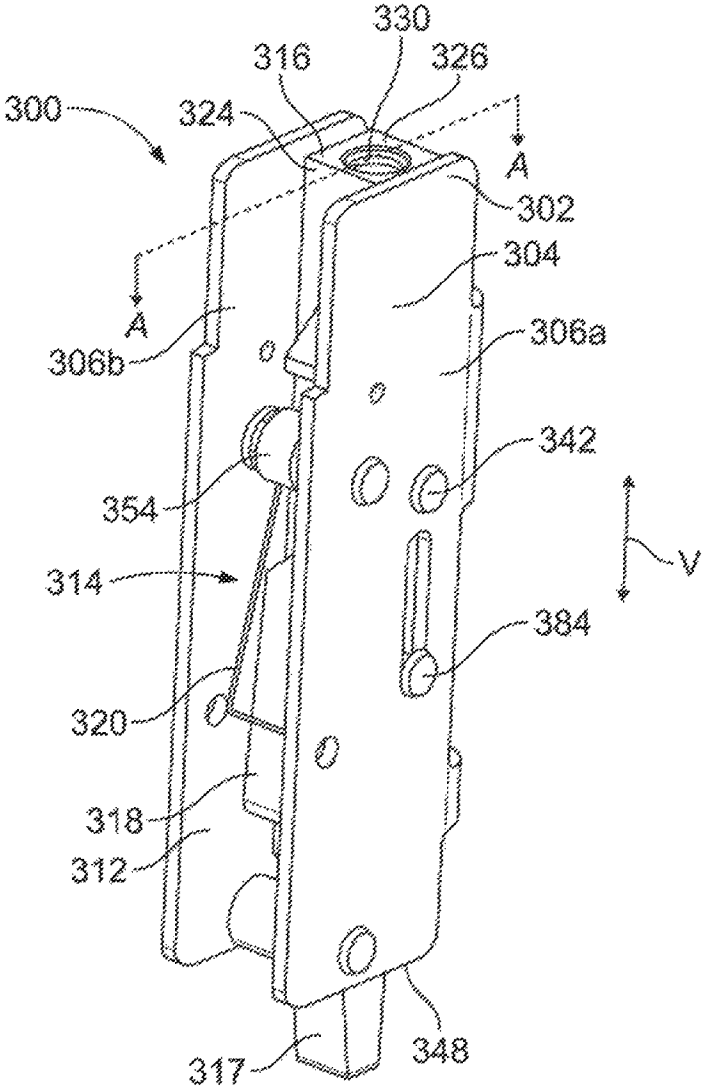
FIG. 2 illustrates a side perspective partial phantom view of a latch mechanism having a latch bolt in an extended, locked position according to an illustrated embodiment of the present invention.

FIGS. 2 and 3 illustrate a latch mechanism 300 according to an illustrated embodiment of the present invention. The latch mechanism 300 may be used as, or as part of, the first latch mechanism 110*a* and/or the second latch mechanism 110*b*. According to certain embodiments, the latch mechanism 300 may include a housing 302 having a sidewall 304. According to the illustrated embodiment, the sidewall 304 may include opposing first and second sidewalls 306*a*, 306*b* that are interconnected to each other by a third sidewall 306*c*. As shown, for example, in FIG. 5, according to certain embodiments, the third sidewall 306*c* may include one or more gaps 308 between segments 310 of the third sidewall 306*c*. Additionally, the sidewalls 306*a*, 306*b*, 306*c* may generally define an inner area 312 of the latch mechanism 300 that may be sized to house at least a portion of an actuator mechanism 314 of the latch mechanism 300, as shown, for example, in FIG. 5.

Figure 5:
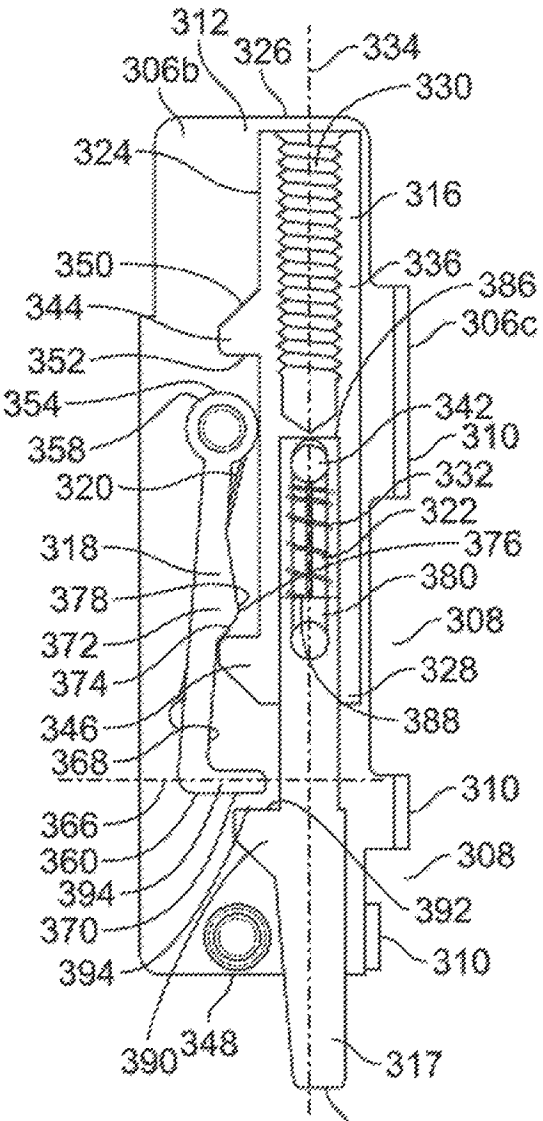
FIG. 5 illustrates a side cross-sectional view of the latch mechanism shown in FIG. 2 taken along line A-A.
Figure 4:
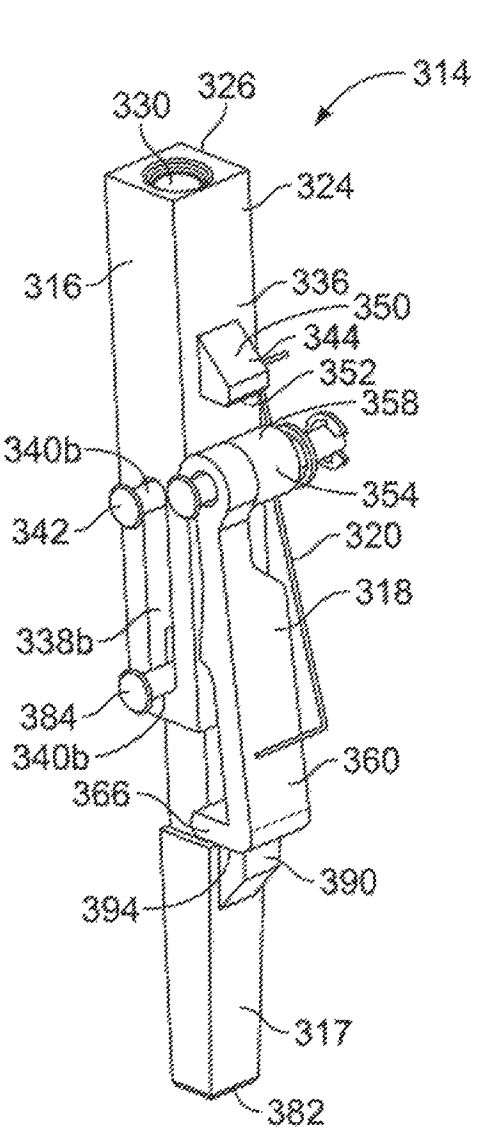
FIG. 4 illustrates a side perspective view of an actuator mechanism for the latch mechanism shown in FIG. 2 according to an illustrated embodiment of the present invention.
Figure 7B:
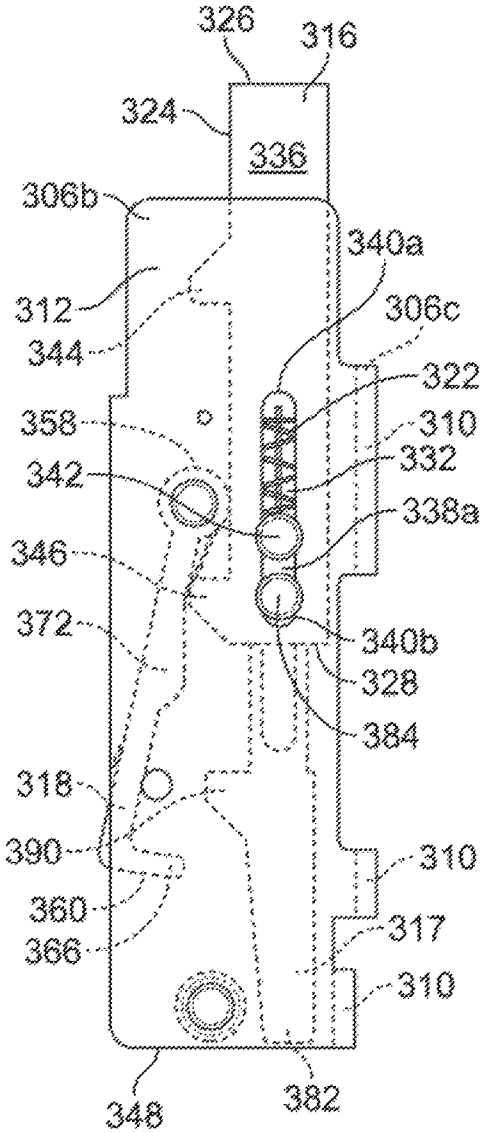
FIGS. 7*a* and 7*b* illustrate a cross-sectional view and an inside side view, respectively, of the latch mechanism shown in FIG. 2 with the actuator mechanism, including the latch bolt, in a retracted, unlocked position.
Figure 7A:
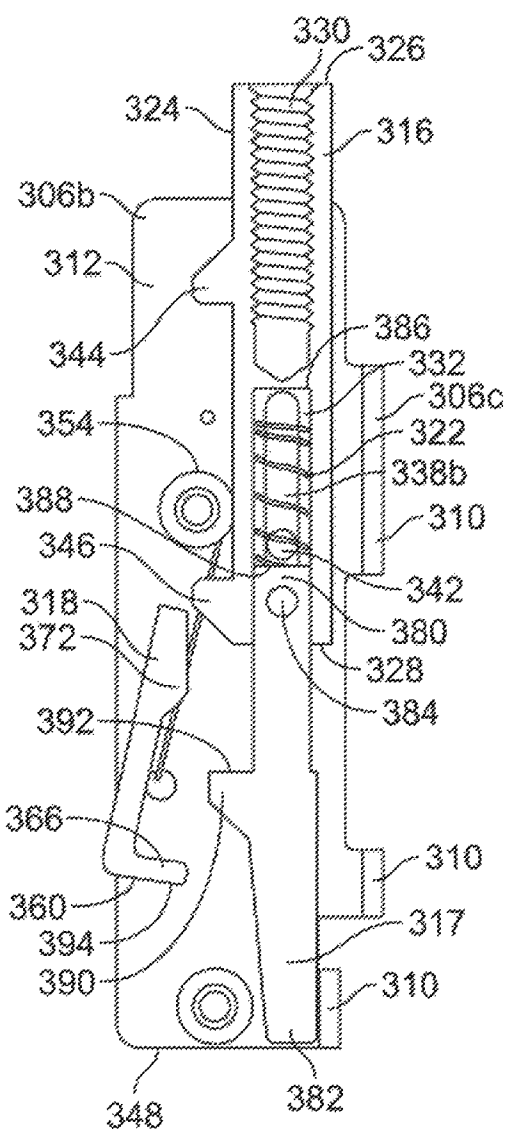

As shown in FIGS. 4 and 5, the actuator mechanism 314 may include a displacement rod or connector 316, a latch bolt 317, a lever member 318, a lever biasing element 320, and a latch biasing element 322. The displacement rod 316 may include an outer wall 324 having a first end 326 and a second end 328. The first end 326 may be configured for operable connection to a rod or cable 112 of the exit device 100. According to the illustrated embodiment, during generally typical opening of a closed, locked door 102, when the latch bolt 317 is to be displaced from an extended, locked position, as shown for example, in FIG. 5, to a retracted, unlocked position, as shown for example in FIG. 7, activation of the push bar or trim 108 may cause the rod or cable 112 to exert a pulling force on the displacement rod 316 that causes displacement of the displacement rod 316 generally in a vertical direction ("V" direction in FIG. 2). Moreover, when in the retracted, unlocked position, at least a portion of the latch bolt 317 is positioned so that the latch bolt 317 does not protrude from the latch mechanism 300 in a manner that would prevent the door 102 from being displaced from a closed position to an open position.

The first end 326 of the displacement rod 316 may be connected to the rod or cable 112 in a number of different manners. For example, according to certain embodiments, the displacement rod 316 may be adapted to be secured to the rod or cable 112 using a mechanical connection, including, for example, a bolt, screw, pin, clamp, or threaded connection, among other connections. In the illustrated embodiment, the displacement rod 316 includes a first aperture 330 having an internal thread that is adapted to mate an external thread of, or that is coupled to, the rod or cable 112.

The second end 328 of the displacement rod 316 includes a second aperture 332 that is configured to receive the slideable insertion of at least a portion of the latch bolt 317. Moreover, as discussed below, the second aperture 332 may be configured to receive the slideable insertion of at least a portion of the latch bolt 317. For example, according to the illustrated embodiment, the second aperture 332 may have a length along a longitudinal centerline 334 of the displacement rod 316 that allows for the second aperture 332 to receive the slideable insertion of at least a portion of the latch bolt 317, as discussed below and as shown in FIG. 5.

A body segment 336 of the displacement rod 316 may also include at least one slot 338 that is in fluid communication with the second aperture 332. For example, in the illustrated embodiment, the displacement rod 316 includes opposing first and second slots 338*a*, 338*b*. The slots 338*a*, 338*b* of the displacement rod 316 are generally elongated along a central axis that is generally parallel to the longitudinal centerline 334 of the displacement rod 316. Further, the elongated slots 338, 338*b* may extend between first and second ends 340*a*, 340*b* of the slot 338*a*, 338*b*. One or more of the slots 338*a*, 338*b* are adapted to receive at least one static pin 342 that is operably connected to the sidewall 306*a*, 306*b* of the housing 302. According to the illustrated embodiment, the position of the static pin 342 may remain relatively static relative to the sidewall 306*a*, 306*b* of the housing 302. The slots 338*a*, 338*b* however are configured such that the position of the slots 338*a*, 338*b* relative to the static pin 342 changes as the displacement rod 316 is displaced.

As shown in FIGS. 3-5, the displacement rod 316 may include an upper protrusion 344 and a lower protrusion 346. In the illustrated embodiment, the upper and lower protrusions 344, 346 are positioned on the same side of the displacement rod 316. However, according to other embodiments, the upper and lower protrusions 344, 346 may be positioned on different sides of the displacement rod 316. The upper protrusion 344 may be configured to at least assist in limiting the distance that the displacement rod 316 may travel generally toward a distal end 348 of the housing 302 as the displacement rod 316 moves to its extended, locked position. For example, according to certain embodiments, the upper protrusion 344 may include an inclined wall 350 and a base wall 352. The base wall 352 may be sized such that at least a portion of the base wall 352 projects a distance away from the body segment 336 of the displacement rod 316 to a degree that allows the base wall 352 to abut against at least a portion of an upper pin structure 354 when the displacement rod 316 is displaced to the extended, locked position of the displacement rod 316. However, according to certain embodiments, the displacement rod 316 may be configured to prevent, or other otherwise limit, instances in which the displacement rod 316 is displaced to a degree that may cause the base wall 352 to contact the upper pin structure 354.

The lower protrusion 346 of the displacement rod 316 may be configured to engage at least a portion of the lever member 318 at least when the displacement rod 316 is being displaced from the extended, locked position, to a retracted, unlocked position. Referring now to FIGS. 5-8*b*, the lever member 318 may include a body portion 356 having a proximate end 358 and a distal end 360. The proximate end 358 includes an aperture 362 that receives or otherwise engages at least a portion of an upper pin 364. According to such an embodiment, the lever member 318 may be pivotally displaced about the upper pin 364 from an extended, locked position, as shown, for example, in FIG. 5, to a retracted, unlocked position, as shown, for example, in FIG. 7*b*. Additionally, according to certain embodiments, the upper pin 364 may be at least a portion of, and/or at least partially housed within or extended from, the upper pin structure 354.

The distal end 360 of the lever member 318 may include a foot portion 366 that extends away from the body portion 356 of the lever member 318. As shown in at least FIG. 5, according to certain embodiments, the foot portion 366 may extend from an interior sidewall 368 of the body portion 356 of the lever member 318. Additionally, according to the illustrated embodiment, when the lever member 318 is in a first position, the foot portion 366 may extend along a foot axis 370 that is generally perpendicular to the longitudinal centerline 334 of the displacement rod 316. Further, the foot portion 366 may be biased toward the first position by a lever biasing element 320. The foot portion 366 is adapted to prevent the latch bolt 317 from being displaced or lifted to a retracted, unlocked position without the displacement rod 316 also being operably retracted from an extended, locked position. For example, as discussed below, when the latch mechanism 300 is to remain secured in the extended, locked position, the foot portion 366 of the lever member 318 may provide a security mechanism that prevents unauthorized lifting or displacement of the latch bolt 317 in a manner that may displace the latch bolt 317 for a locking engagement with an adjacent structure.

The lever member 318 may also include an abutment member 372 that extends from a portion of the interior sidewall 368 away from the body portion 356 of the lever member 318. The abutment member 372 is adapted to be engaged or abutted by the lower protrusion 346 of the displacement rod 316 as the displacement rod 316 is displaced generally in a vertical direction ("V" direction in FIG. 2) from the extended, locked position to the retracted, unlocked position. According to the depicted embodiment, the abutment member 372 may include a lower transition surface 374 that extends away from the interior sidewall 368 until reaching an abutment apex 376. The abutment apex 376 may be positioned on the abutment member 372 at the location at which the abutment member 372 is extended outwardly the furthest from the interior sidewall 368 or body portion 356 of the lever member 318. The lower transition surface 374 may have a variety of different configurations, including, for example, being a curved and/or relatively flat inclined surface. Additionally, according to the illustrated embodiment, the abutment member 372 may include an upper transition surface 378 that outwardly extends from the body portion 356 toward the abutment apex 376, and which is joined to, or intersects, the lower transition surface 374 at the abutment apex 376.

The latch bolt 317 includes an upper portion 380 and a lower portion 382. At least a portion of the upper portion 380 of the latch bolt 317 is configured to be received in the second aperture 332 of the displacement rod 316 during operation of the actuator mechanism 314. Additionally, the upper portion 380 of the latch bolt 317 may include a protrusion, such as, for example, a pin 384, that extends from or through the latch bolt 317 and into one or more of the first slot 338*a* and/or the second slot 338*b* of the displacement rod 316. According to the illustrated embodiment, the pin 384 may be positioned within one or more of the first and second slots 338*a*, 338*b* so as to least assist in retaining the latch bolt 317 in engagement with the displacement rod 316. Further, the pin 384 may be adapted for displacement within the corresponding slot(s) 338*a*, 338*b* as the latch bolt 317 is displaced between retracted and extended positions.

A latch biasing element 322 may be adapted to bias a position of the latch bolt 317 relative to the displacement rod 316. For example, according to certain embodiments, the latch biasing element 322 may be structured and/or positioned to bias the latch bolt 317 in and/or toward the extended, locked position. According to the depicted embodiment, the latch biasing element 322 is a spring that is positioned within the second aperture 332 of the displacement rod 316 and extends from an upper wall 386 of the second aperture 332 to an upper surface 388 of the latch bolt 317. However, the latch biasing element 322 may be positioned at a variety of other locations, and/or be operably coupled to the latch bolt 317 in a number of other manners.

FIGS. 5-7*b* illustrate the latch mechanism 300 in different stages of displacement of the displacement rod 316 and the actuator mechanism 314, including the latch bolt 317. In FIG. 5, the lower protrusion 346 of the displacement rod 316 is positioned at a distance below the abutment apex 376 of the lever member 318 such that engagement between the lower protrusion 346 and the abutment member 372, if any, maintains the foot portion 366 at a position in which the foot portion 366 impedes, or otherwise prevents, the displacement of the latch bolt 317 to a retracted, unlocked position. More specifically, according to the embodiment shown in FIGS. 2-7*b*, the latch bolt 317 includes a bolt protrusion 390 having an upper surface 392 that is positioned on at least one side of the latch bolt 317, and which is configured to engage at least a lower region 394 of the foot portion 366 of the lever member 318 when the latch bolt 317 is not to be displaced to the retracted from the extended, locked position to the retracted, unlocked position. Moreover, as shown in FIG. 5, when the latch mechanism 300 is in the locked position, the foot portion 366 of the lever member 318 is positioned such that, in the event there is unauthorized attempt to lift the latch bolt 317 to the retracted, unlocked position, such as, for example, attempting to displace the latch bolt 317 with a tool or finger, the foot portion 366 of the lever member 318 is positioned to be engaged by the bolt protrusion 390 in a manner that prevents the latch bolt 317 from reaching the retracted, unlocked position.

Figure 6:
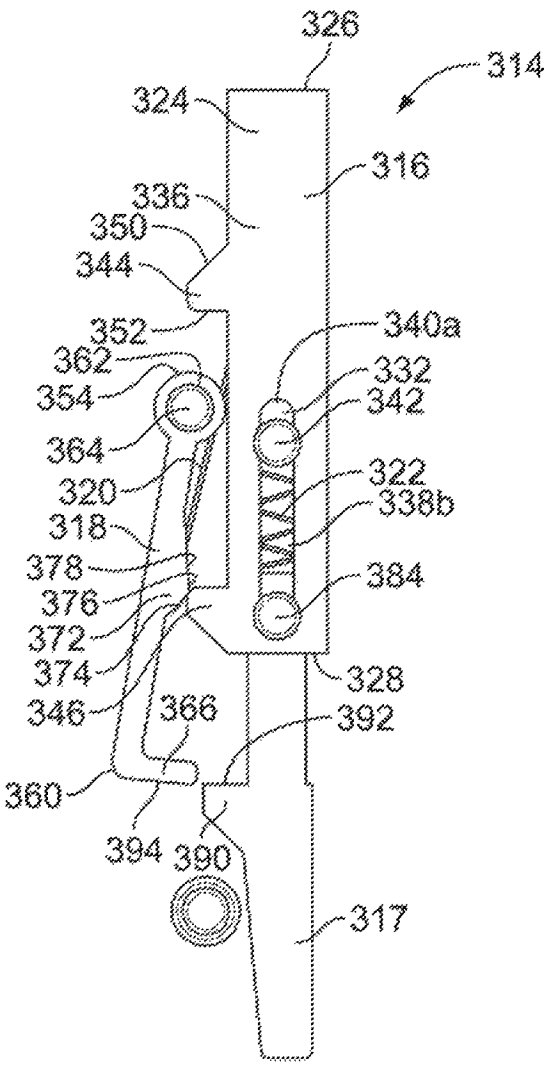
FIG. 6 illustrates a side view of a portion of the latch mechanism shown in FIG. 2 with the latch bolt at a transition position between the extended, locked position and the retracted, unlocked position.

When the latch bolt 317 is to be displaced to the retracted, unlocked position, operation of the exit device 100 may cause a rod or cable 112 to provide a pushing or pulling force that displaces the displacement rod 316, and thus the latch bolt 317, toward the retracted, unlocked position. As illustrated in FIG. 6, as the displacement rod 316 is displaced toward the retracted, unlocked position, the lower protrusion 346 may be displaced along at least a portion of the lever member 318. Moreover, as the displacement rod 316 is displaced, the lower protrusion 346 may travel toward and/or contact the abutment apex 376. Such contact may pivotally displace at least a portion of the lever member 318, and more particularly the foot portion 366, from the first position to a second position away from the latch bolt 317, as shown in FIG. 6. Thus, the engagement between the lower protrusion 346 of the displacement rod 316 and the abutment apex 376 may overcome the biasing force of the lever biasing element 320 such that the lever member 318 may be displaced to the second position. With the lever member 318 in the second position, the foot portion 366 is not in a position to be engaged by the bolt protrusion 390 or otherwise impede the displacement of the latch bolt 317. The displacement rod 316 and latch bolt 317 may then continue to be displaced to the retracted, unlocked position, as shown, for example, in FIGS. 7*a* and 7*b*.

Figure 8B:
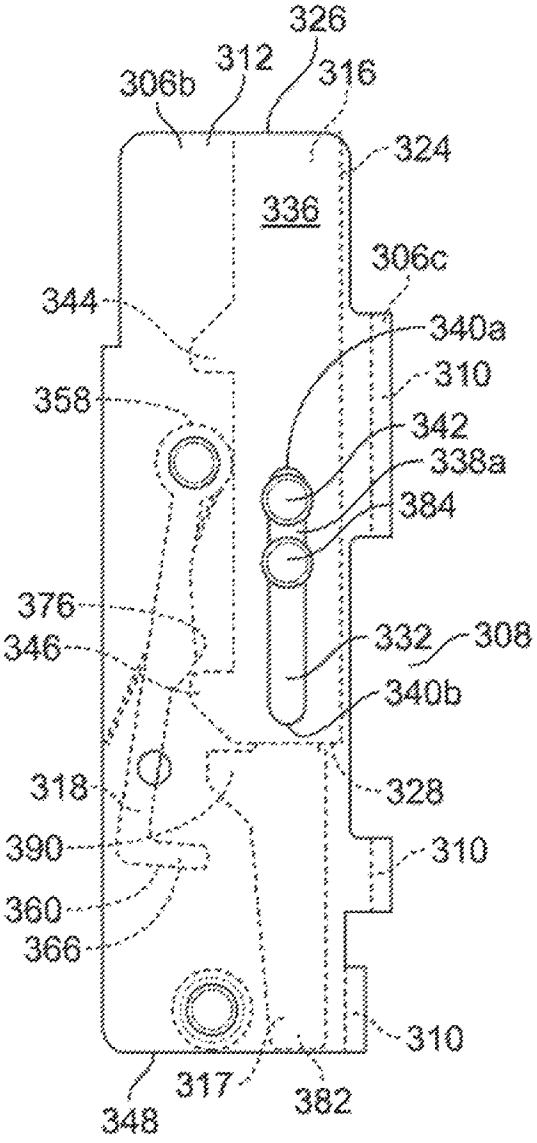
FIGS. 8*a* and 8*b* illustrate a cross-sectional side view and an inside side view, respectively, of the latch mechanism shown in FIG. 2 with the latch bolt in a retracted, unlocked position while at least the displacement rod is in the extended, locked position.
Figure 8A:
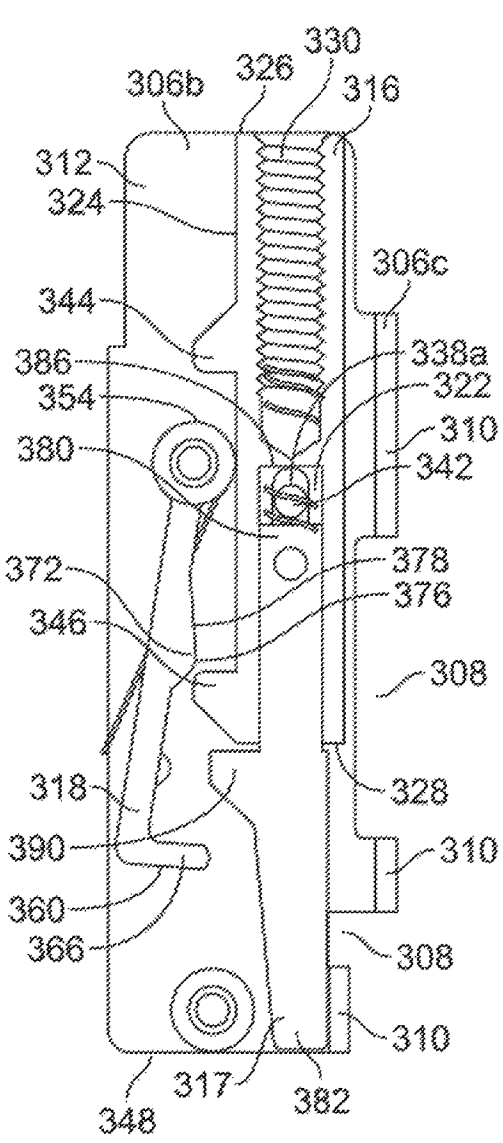

FIGS. 8*a* and 8*b* illustrate a situation in which an exit device 100 having an inter-related top or upper latch mechanism (not shown) and a bottom or lower latch mechanism has been deactivated but the latch bolt 317 of one or more of those latch mechanisms 300 has not returned to its extended, locked position. According to the illustrated embodiment, the latch mechanism 300 is configured to at least attempt to prevent situations in which the failure of the latch bolt 317 of the top and/or bottom latch mechanism to return to the extended, locked position from interfering with the ability of the latch bolt of the other of the top and/or bottom latch from returning to an extended, locked position. Moreover, the second aperture 332 may have a generally elongated configuration that is sized to receive a portion of the latch bolt 317. For example, as shown in FIGS. 8*a* and 8*b*, according to certain embodiments, the second aperture 332 is sized to receive insertion of at least a portion of the latch bolt 317 that extends from the upper portion 380 of the latch bolt 317 to about the lower portion 382 of the latch bolt 317. Thus, in the event that a latch bolt 317 is not returning to the extended, unlocked position after de-activation of the exit device 100, including upon closure of the door 102, as the rods or cables 112, and thus the displacement rod 316 are returned to their extended, locked positions, the displacement rod 316 may slide over at least a portion of the relatively static or stuck latch bolt 317. Moreover, as the displacement rod 316 returns to its extended, locked position, the second aperture 332 may slide around the latch bolt 317 until the displacement rod 316, and the associated rod or cable 112, returns to their extended, locked positions. Further, as the distance between the upper surface 388 of the latch bolt 317 and the upper wall 386 of the second aperture 332 decreases, the biasing force exerted by the latch biasing element 322 against the latch bolt 317 may increase, which may further facilitate the displacement of the latch bolt 317 to the extended, locked position. Further, the return of the displacement rod 316 and associated rod or cable 112 to their extended locked positions prevents those components from interfering with the ability of the other, inter-related latch and associated rod or cable 112 from returning to their extended, locked positions.

FIGS. 9*a*-14 illustrate another embodiment of the latch mechanism 400 having an actuator mechanism 402 that includes a latch bolt 404. The latch mechanism 400 may be used as, or as part of, the first latch mechanism 110*a* and/or the second latch mechanism 110*b*. According to certain embodiments, the latch mechanism 400 may include a housing 406 having a sidewall 408. According to the illustrated embodiment, the sidewall 408 may include opposing first and second sidewalls 408*a*, 408*b* that are interconnected to each other by a third sidewall 408*c*. As shown, for example, in FIG. 10*a*, according to certain embodiments, the third sidewall 408*c* may include one or more gaps 410 between segments 412 of the third sidewall 408*c*. Additionally, the sidewalls 408*a*, 408*b*, 408*c* may generally define an inner area 414 of the latch mechanism 400 that may be sized to house at least a portion of an actuator mechanism 402 of the latch mechanism 400, as shown, for example, in FIG. 9*b*.

Figures 9A, 9B, 9C:
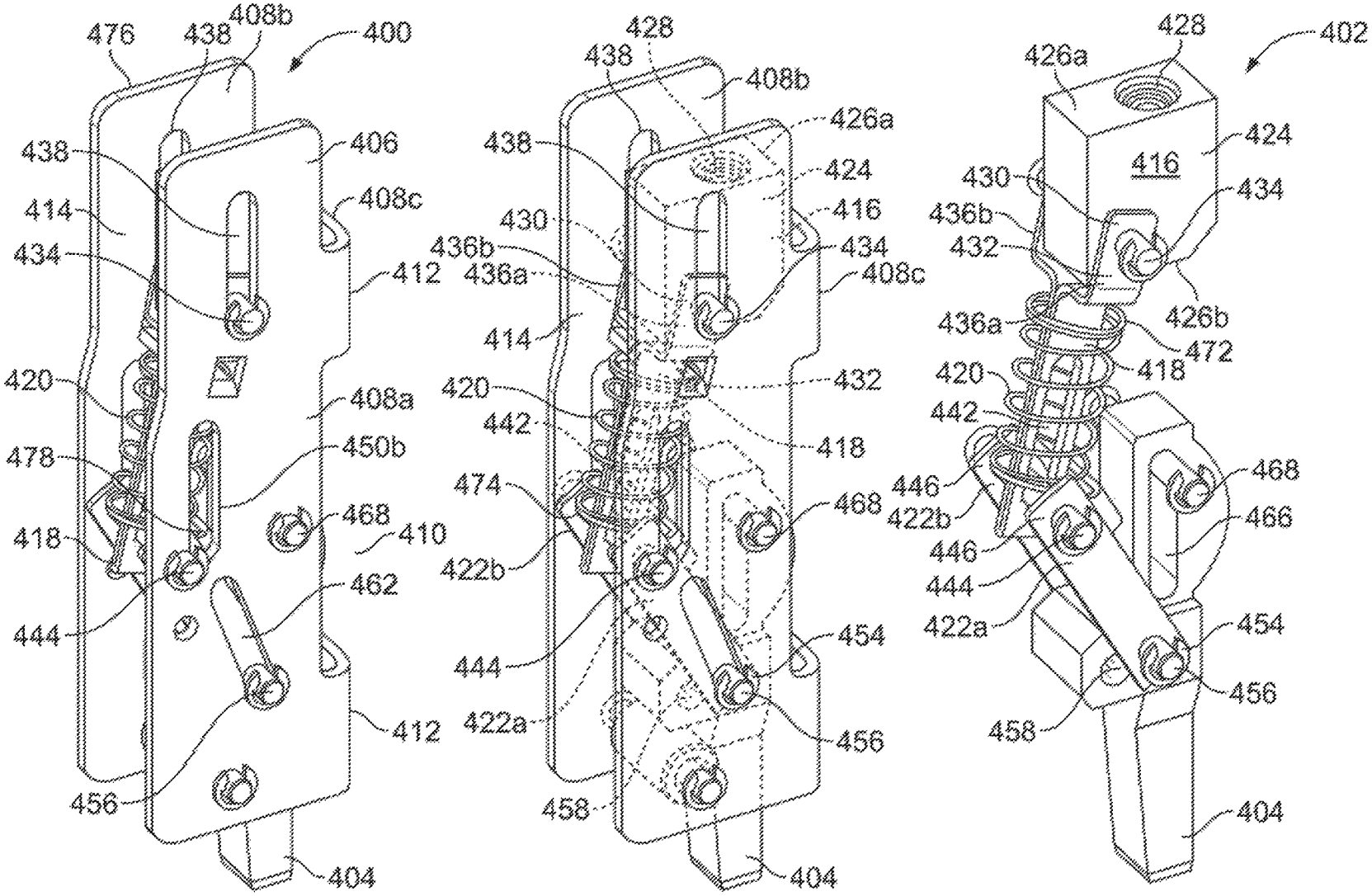
FIGS. 9*a* and 9*b* illustrate a side perspective and side partial phantom view, respectively, of a latch mechanism having a latch bolt in an extended, locked position according to an illustrated embodiment of the present invention.
FIG. 9*c* illustrates a side perspective view of an actuator mechanism for the latch mechanism shown in FIG. 9*a* according to an illustrated embodiment of the present invention.

As shown in FIG. 9*c*, the actuator mechanism 402 may include a displacement rod or connector 416, a latch bolt 404, a first link 418, a biasing element 420, and one or more second links 422*a*, 422*b*. The displacement rod 416 may include an outer wall 424 having a first end 426*a* and a second end 426*b*. The first end 426*a* may be configured for operable connection to a rod or cable 112 of the exit device 100. According to the illustrated embodiment, during generally typical opening of a closed, locked door 102, when the latch bolt 404 is to be displaced from an extended, locked position, as shown for example, in FIG. 9*a*, to a retracted, unlocked position, as shown for example in FIG. 11*b*, activation of the push bar or trim 108 may cause the rod or cable 112 to exert a pulling force on the displacement rod 416 that causes displacement of the displacement rod 416 generally in a vertical direction ("V" direction in FIG. 10*a*). Moreover, when in the retracted, unlocked position, at least a portion of the latch bolt 404 is positioned so that the latch bolt 404 does not protrude from the latch mechanism 400 in a manner that would prevent the door 102 from being displaced from a closed position to an open position.

The first end 426*a* of the displacement rod 416 may be connected to the rod or cable 112 in a number of different manners. For example, according to certain embodiments, the displacement rod 416 may be adapted to be secured to the rod or cable 112 using a mechanical connection, including, for example, a bolt, screw, pin, clamp, or threaded connection, among other connections. In the illustrated embodiment, the displacement rod 416 includes a first aperture 428 having an internal thread that is adapted to mate an external thread of, or that is operably coupled to, the rod or cable 112.

Figure 10B:
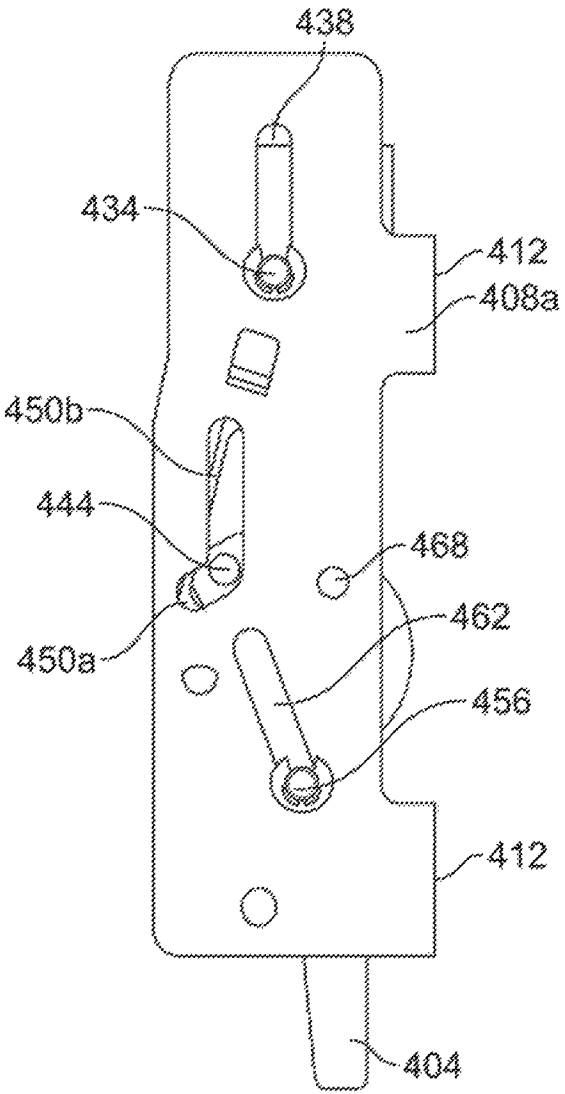
FIG. 10*b* illustrates a side view the latch mechanism illustrated in FIG. 10*a*.
Figure 14:
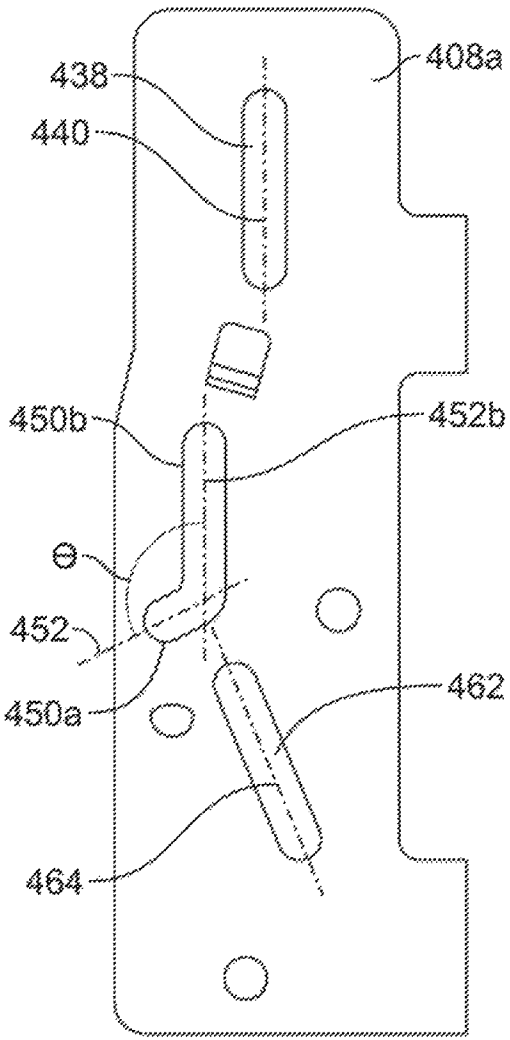
FIG. 14 illustrates a side view of a first side of the housing of the latch mechanism shown in FIG. 9*a*.

A first end 430 of a body portion 432 of the first link 418 may be pivotally connected to the displacement rod 416. For example, according to the illustrated embodiment, the first link 418 may be pivotally connected to a first link pin 434 that extends or protrudes from the displacement rod 416. Further, as shown in FIG. 9*c*, according to certain embodiments, the first end 430 of the first link 418 may include a first leg 436*a* and a second leg 436*b* that are spaced apart such that at least a portion of the displacement rod 416 may be positioned there-between. According to such an embodiment, the first link pin 434 may comprise one or more pins or protrusions that pivotally couple the displacement rod 416 to the first and second legs 436*a*, 436*b*. Additionally, as shown in FIG. 10*b*, according to certain embodiments, the first link pin 434 may extend into a first housing slot 438 in the first and/or second sidewall 408*a*, 408*b* of the housing 406. According to the illustrated embodiment, as shown in FIG. 14, the first housing slot 438 may have an elongated configuration that generally extends along an axis 440 that is parallel to the direction of movement of the displacement rod 414 when the displacement rod 416 is displaced by actuation of the exit device 100, such as, for example, when the latch bolt 404 is being moved between the extended, locked position and the retracted, unlocked positions.

The body portion 432 of the first link 418 may include a generally elongated link slot 442 that extends along at least a portion of the first link 418. The link slot 442 may be configured to permit the slideable displacement of a second link pin 444 along the link slot 442. The second link pin 444 may extend through or protrude from a first end 446 of the second links 422*a*, 422*b*. Moreover, the first link 418 and the second links 422*a*, 422*b* may be pivotally coupled to the second link pin 444.

The second link pin 444 may be configured for slideable displacement along one or more second housing slots 448 that are positioned along the first and/or second sidewall 408*a*, 408*b* of the housing 406. According to the illustrated embodiment, as shown in FIG. 14, the second housing slot 448 may have a dog-legged configuration. For example, a first portion 450*a* of the second housing slot 448 may extend along a first axis 452*a*, while a second portion 450*b* of the second housing slot 448 extends along a second axis 452*b*, the first axis 452*a* extending away from the second axis 452*b* by an angle (θ) that is greater than 90 degrees, as shown, for example, in FIG. 14. Further, according to the illustrated embodiment, the second axis 452*b* may be generally parallel to the direction of travel of the displacement rod 416 when the displacement rod 416 is displaced between the extended, locked position and the retracted, unlocked position. Moreover, the second axis 452*b* of the second portion 450*b* of the second housing slot 448 may be generally parallel to the axis 440 of the first housing slot 438.

Figure 10A:
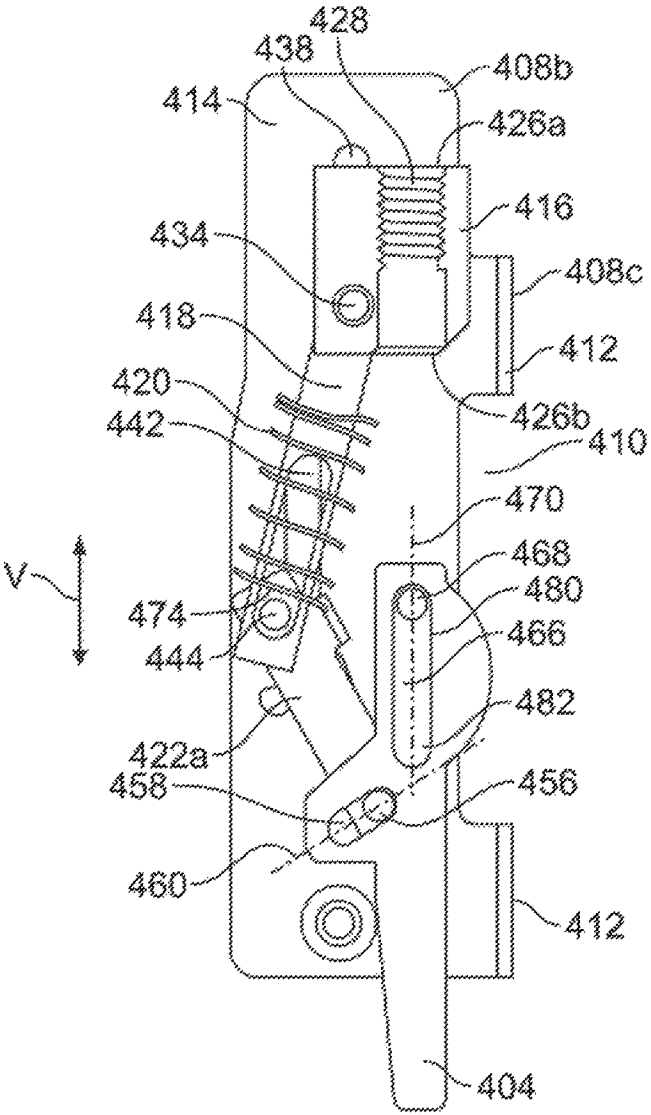
FIG. 10*a* illustrates a cross-sectional side view of a portion of the latch mechanism shown in FIG. 9*a* with the latch bolt and associated components of the actuator mechanism in an extended, locked position.

A second end 454 of the second links 422*a*, 422*b* may be pivotally coupled to a first latch pin 456 that extends into and/or through a first latch slot 458 in the latch bolt 404. According to the illustrated embodiment, the first latch slot 458 is sized to accommodate the slideable displacement of the first latch pin 456 within the first latch slot 458. Further, as shown in FIG. 10*a*, the first latch slot 458 may extend along an axis 460 arranged generally parallel to the first axis 452*a* of the first portion 450*a* of the second housing slot 448. Additionally, as shown in FIG. 9*a*, the first latch pin 456 may extend into a third housing slot 462 in the first and/or second sidewall 408*a*, 408*b* of the housing 406. As shown in FIG. 14, the third housing slot 462 may have a generally elongated shape that extends along an axis 464 that is not parallel to the axis 440 of the first housing slot 438. Further, according to certain embodiments, the axis 464 of the third housing slot 462 may be generally perpendicular to, and non-intersecting with, the axis 460 of the first latch slot 458.

The latch bolt 404 may also include a second latch slot 466 that also has a generally elongated shape that is sized to accommodate the slideable displacement of the latch bolt 404 about a static latch pin 468. Moreover, according to the illustrated embodiment, the static latch pin 468 may be in a generally fixed position relative to the housing 406. Thus, according to certain embodiments, the static latch pin 468 may extend from a generally fixed location in the housing 406. As shown in FIG. 10*a*, the second latch slot 466 may extend along an axis 470 that is generally parallel to the second axis 452*b* of the second portion 450*b* of the second housing slot 448, as well as the axis 440 of the first housing slot 438. Moreover, the axis 470 of the second latch slot 466 may be generally parallel to at least the direction of displacement of the latch bolt 404 as the latch bolt 404 moves between the extended, locked position and the retracted, unlocked position.

According to the illustrated embodiment, the biasing element 420 is adapted to exert a force that biases the first link 418 to the position that the first link 418 typically is at when the latch bolt 404 is in the extended, locked position. According to the illustrated embodiment, the biasing element 420 extends along or about the body portion 432 of the first link 418 and is coupled at a first end 472 to the housing 406 and coupled to the second link pin 444 at a second end 474 of the biasing element 420. However, the biasing element 420 may be positioned at a number of other locations. For example, according to certain embodiments, at least a portion of the biasing element 420 may be coupled to the latch bolt 404 such that the biasing element 420 exerts a force directly on the latch bolt 404 that biases the latch bolt 404 toward the extended, locked position.

Figure 13B:
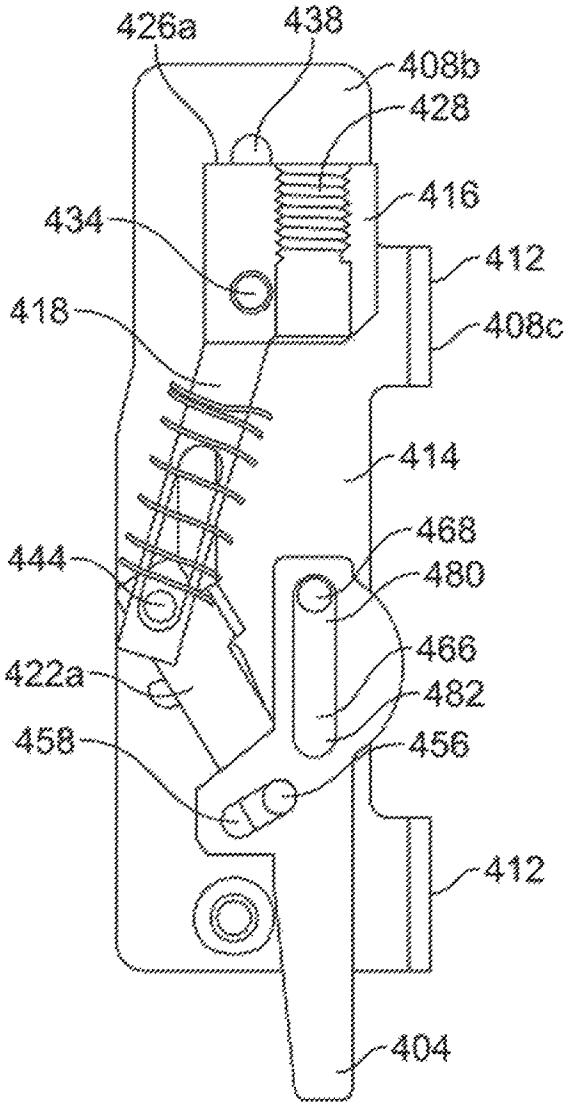
FIG. 13*b* illustrates a cross-sectional side view of the latch mechanism shown in FIG. 9*a* with the actuator mechanism, including the latch bolt, in an extended, locked position.
Figure 13A:
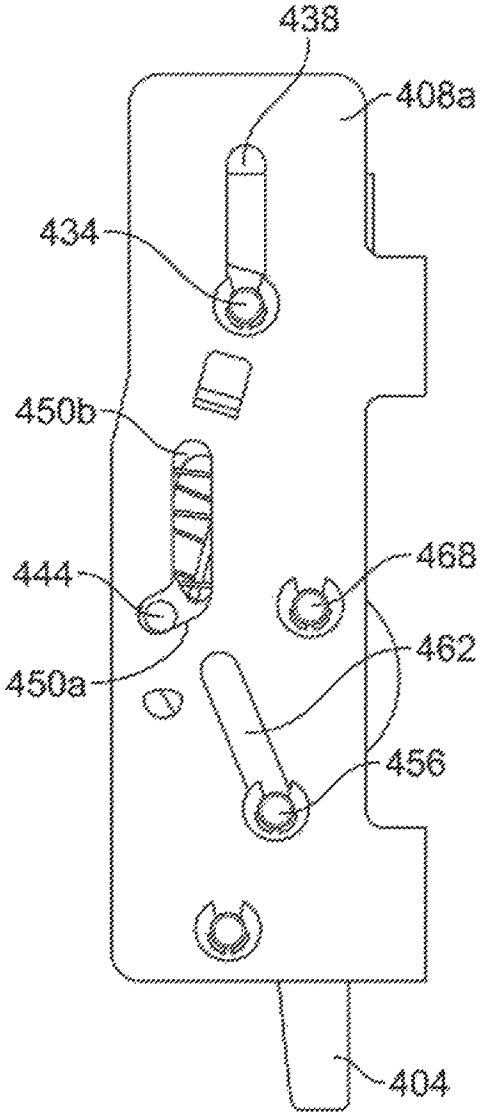
FIG. 13*a* illustrates a side view of the latch mechanism shown in FIG. 9*a* with the actuator mechanism, including the latch bolt, in an extended, locked position.

As shown in FIGS. 13*a* and 13*b*, when the actuator mechanism 402, and more specifically, the latch bolt 404, is in the extended, locked position, the second link pin 444 may be positioned about a region of the first portion 450*a* of the second housing slot 448 that is spaced away from the second portion 450*b* of the second housing slot 448. When in such a position, illicit attempts to unlock the latch mechanism 400, such as, for example, using a tool(s) or a finger(s) to apply a force directly against the latch bolt 404 to vertically lift the latch bolt 404 will result in the force being transferred to the second link pin 444. However, as the second link pin 444 is at a location in the first portion 450*a* of the second housing slot 448 that is offset from, or away from, the second portion 450*b* of the second housing slot 448, the second link pin 444 cannot be vertically displaced to a position that may otherwise allow the latch bolt 404 to be lifted to the retracted, unlocked position. Instead, the vertical nature of lifting force being directly applied to the latch bolt 404 may result in the second link pin 444 pressing against a portion of the first and/or second sidewall 408*a*, 408*b* of the housing 406 that is adjacent to the second link pin 444, thereby transferring the lifting force to the housing 106. Thus, as the second link pin 444 is unable to be vertically displaced in such a situation, the latch bolt 404 will generally remain in the extended, locked position, as shown in FIGS. 13*a* and 13*b*.

When the exit device 100 is activated such that the latch bolt 404 is to be displaced from the extended, locked position to the retracted, unlocked position, a rod or cable 112 that is operably connected to the displacement rod 416 may vertically pull or push the displacement rod 416 in a direction away from the latch bolt 404. As the displacement rod 416 is displaced, the first link pin 434 that is coupled to the displacement rod 416 may also be displaced in generally the same direction as the displacement rod 416. As the first link pin 434 is displaced, the first link pin 434 may exert at least a pulling force on the first link 418 that may result in the first link 418 being generally displaced at least in the direction of the displacement rod 416, as well as being pivotally displaced about the first link pin 434 in a direction wherein the first link 418 moves to being closer to being parallel to the axis 440 of the first housing slot 438. Accordingly, the first portion 450*a* of the second housing slot 448 may be at least angularly oriented along the axis 440 to accommodate both the displacement of the first link 418 generally toward an upper surface 476 of the housing 406 and the pivotal displacement of the first link 418. Upon reaching the opening 478 of the second portion 450*b* of the second housing slot 448, as shown in FIG. 10*b*, the second link pin 444 may be displaced along the second portion 450*b* in a direction generally toward the upper surface 476 of the housing 406.

Figure 11B:
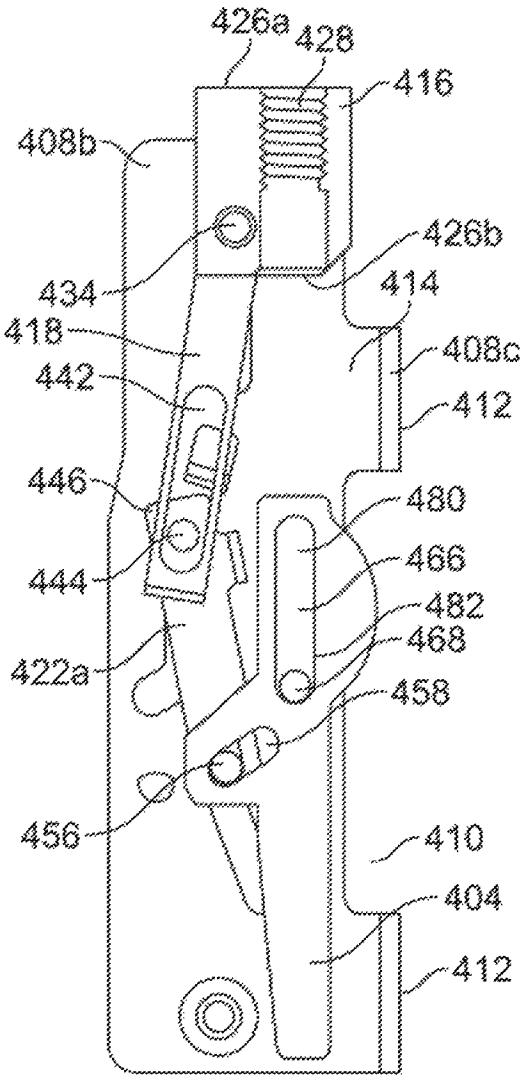
FIG. 11*b* illustrates a cross-sectional side view of the latch mechanism shown in FIG. 11*a*.
Figure 11A:
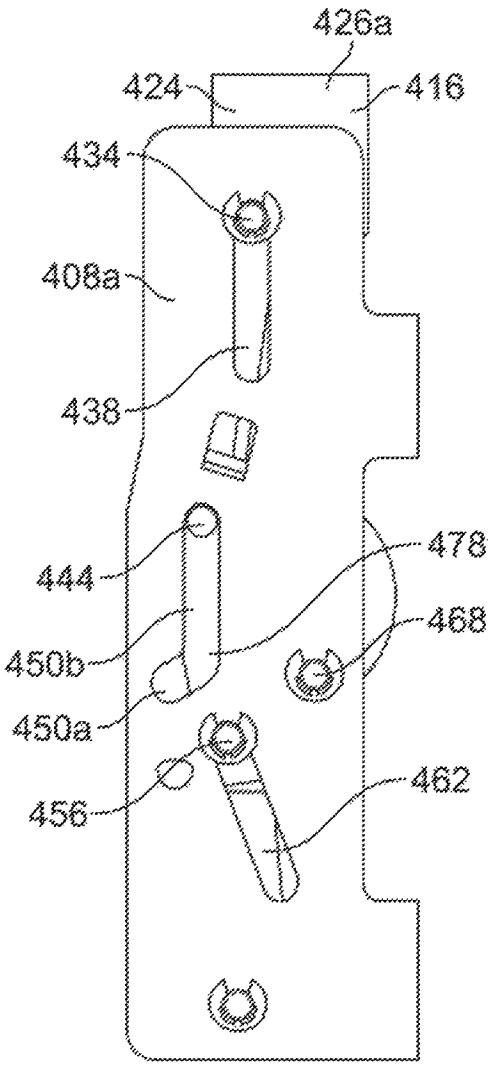
FIG. 11*a* illustrates a side view of the latch mechanism shown in FIG. 9*a* with the actuator mechanism, including the latch bolt, in a retracted, unlocked position.

As the first link 418 is pivotally coupled to the second links 422*a*, 422*b* via the second link pin 444, the displacement of the first link 418, as well as the associated displacement of the second link pin 444 along the first and second portions 450*a*, 450*b* of the second housing slot 448, may result in a surface at a bottom region of the link slot 442 in the body portion 432 of the first link 418 exerting a pushing and/or pulling force on the second links 422*a*, 422*b*, thereby causing both pivotal and vertical displacement of the second links 422*a*, 422*b* from an extended, locked position, as shown in at least FIG. 10*a*, a retracted, unlocked position, as shown in FIG. 11*b*.

Thus, the displacement of the second link pin 444 along the first portion 450*a* of the second housing slot 448 and toward the second portion 450*b* of the second housing slot 448 may cause at least the pivotal displacement of the second links 422*a*, 422*b*. As the second links 422*a*, 422*b* are pivotally displaced, the first latch pin 456 may be displaced along the first latch slot 458 from a first, upper position, as shown in FIG. 10*a*, to a second, lower position about the first latch slot 458, as shown in FIG. 11*b*. Additionally, as the second link pin 444 is displaced along the second portion 450*b* of the second housing slot 448 toward the upper surface 476 of the housing 406, the first latch pin 456 may also be displaced along the third housing slot 462 from a lower position about the third housing slot 462, as shown, for example, in FIGS. 9*a* and 13*a*, to an upper position about the third housing slot 462, as shown, for example, in FIG. 11*a*. As the first latch pin 456 is displaced toward the upper position about the third housing slot 462, the engagement between the first latch pin 456 and the first latch slot 458 may result in the latch bolt 404 being displaced generally in the same direction as the displacement rod 416. Accordingly, the second latch slot 466 may travel about the static latch pin 468 such that the static latch pin 468 goes from being positioned in an upper region 480 to a lower region 482 of the second latch slot 466, and the latch bolt 404 may be displaced to the retracted, unlocked position.

When the latch bolt 404 is to be returned to the extended, locked position, the pulling or pushing force exerted by the cable or rod 112 on the displacement rod 416 may be released. As the displacement rod 416 returns to its respective extended, locked position, the first link pin 434, second link pin 444, and first latch pin 456, as well as the associated first and second links 418, 422, may be displaced so as to return to their associated extended, locked positions. Further, the displacement of at least the first link 418 back to its extended, locked position may be influenced by the biasing force provided by the biasing element 420. In such situations, the return of the displacement rod 416 and the first and second links 418, 422 may influence the return of the latch bolt 404 to its extended, locked position.

Figure 12:
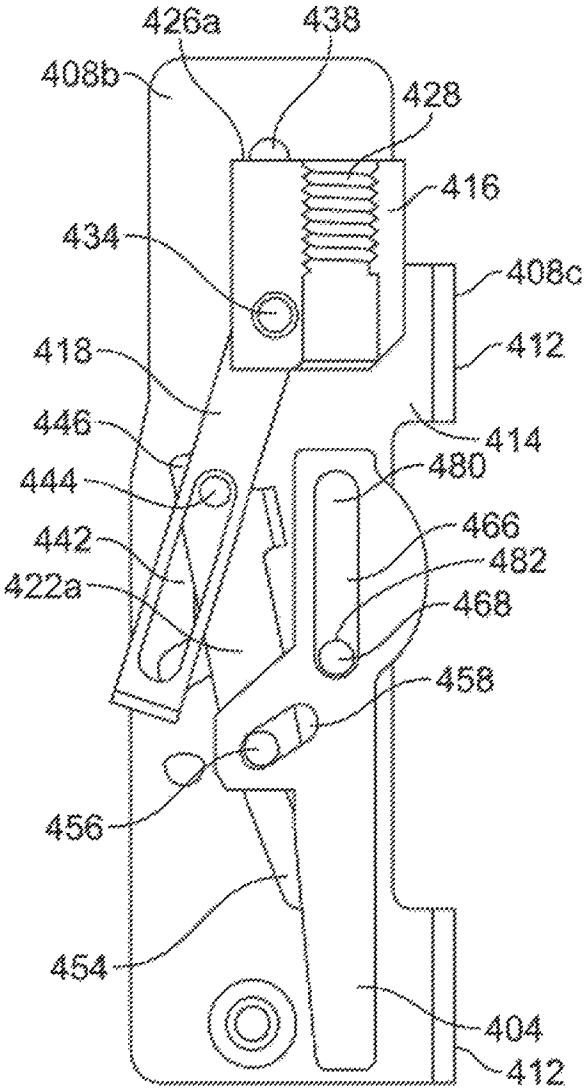
FIG. 12 illustrates a cross-sectional side view of the latch mechanism shown in FIG. 9*a* in which the latch bolt has remained in the retracted, unlocked position while other components of the actuator mechanism have returned to their extended, locked positions.

In certain situations, the latch bolt 404 may remain in the retracted, unlocked position despite the release of the pulling or pushing force that had displaced the displacement rod 416 to the retracted, unlocked position. In such situations, in an effort to prevent another, inter-related latch mechanism from being unable to return its own latch bolt to an extended, locked position, at least the link slot 442 of the latch mechanism 400 that has the retracted latch bolt 404 is adapted to allow at least the displacement rod 416 and associated rod or cable 112 to return to their extended, locked positions. For example, as illustrated in FIG. 12, the link slot 442 of the body portion 432 of the first link 418 may be sized to allow the link slot 442 to slide around the second link pin 444 as the displacement rod 416 returns to its extended, locked position. Thus, in such situations, the second link pin 444 may be closer to an upper region of the link slot 442, as shown in FIG. 12, then when the latch bolt 404 is in the extended, locked position, as shown in FIG. 13*b*.

FIGS. 15-24 illustrate another embodiment of a latch mechanism 500 having an actuator mechanism 502 that includes a latch bolt 504. The latch mechanism 500 may be used as, or as part of, the first latch mechanism 110*a* and/or the second latch mechanism 110*b*. According to certain embodiments, the latch mechanism 500 may include a housing 506 having a sidewall 508. The sidewall 508 may include opposing first and second sidewalls 510*a*, 510*b* that are interconnected to each other by a third sidewall 510*c*. As shown, for example, in FIG. 18, according to certain embodiments, the third sidewall 510*c* may include one or more gaps 512 between segments 514 of the third sidewall 510*c*. Additionally, the sidewalls 510*a*, 510*b*, 510*c* may generally define an inner area 516 of the latch mechanism 500 that may be sized to house at least a portion of an actuator mechanism 502 of the latch mechanism 500, as shown, for example, in FIG. 15*b*.

Figure 15B:
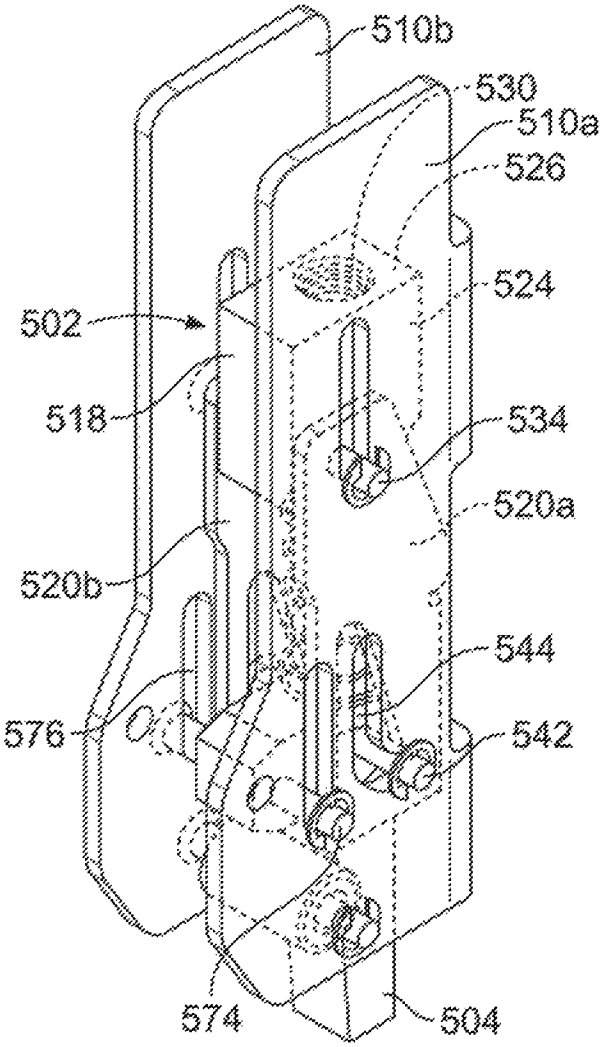
FIG. 15*b* illustrates a side perspective partial phantom view of the latch mechanism illustrated in FIG. 15*a*.
Figure 15A:
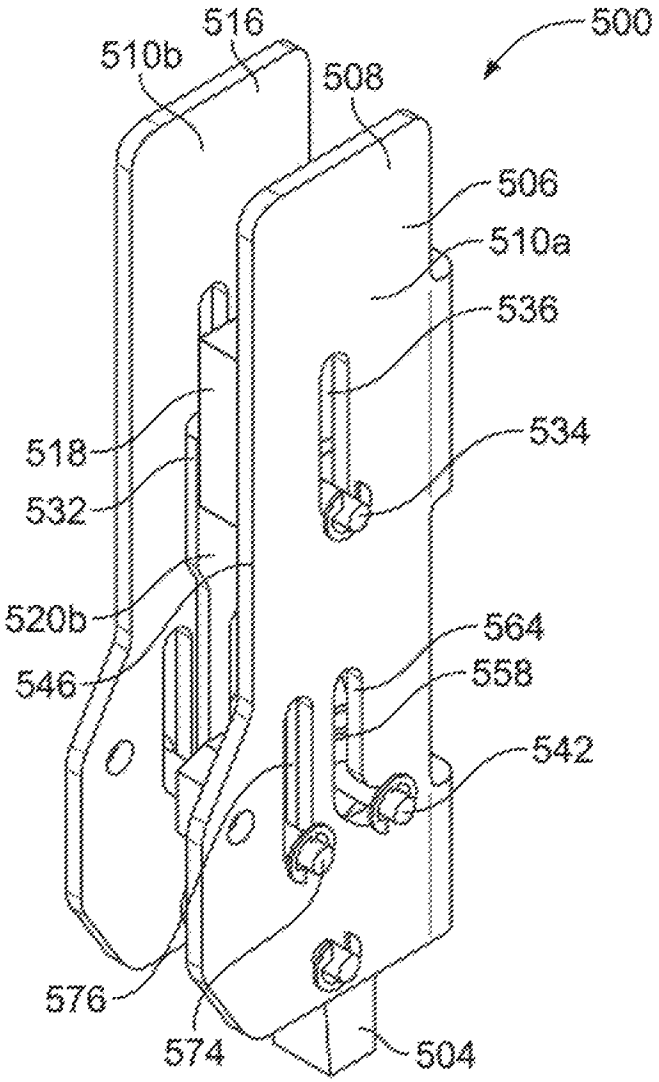
FIG. 15*a* illustrates a side view of a latch mechanism having a latch bolt in an extended, locked position according to an illustrated embodiment of the present invention.
Figure 16:
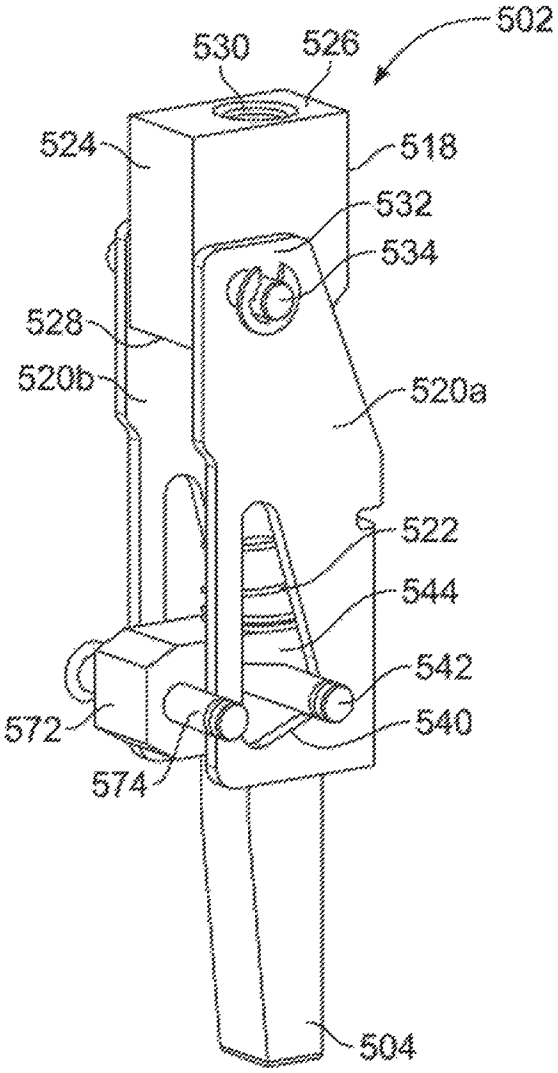
FIG. 16 illustrates a side perspective view of an actuator mechanism for the latch mechanism shown in FIG. 15*a* according to an illustrated embodiment of the present invention.
Figure 19:
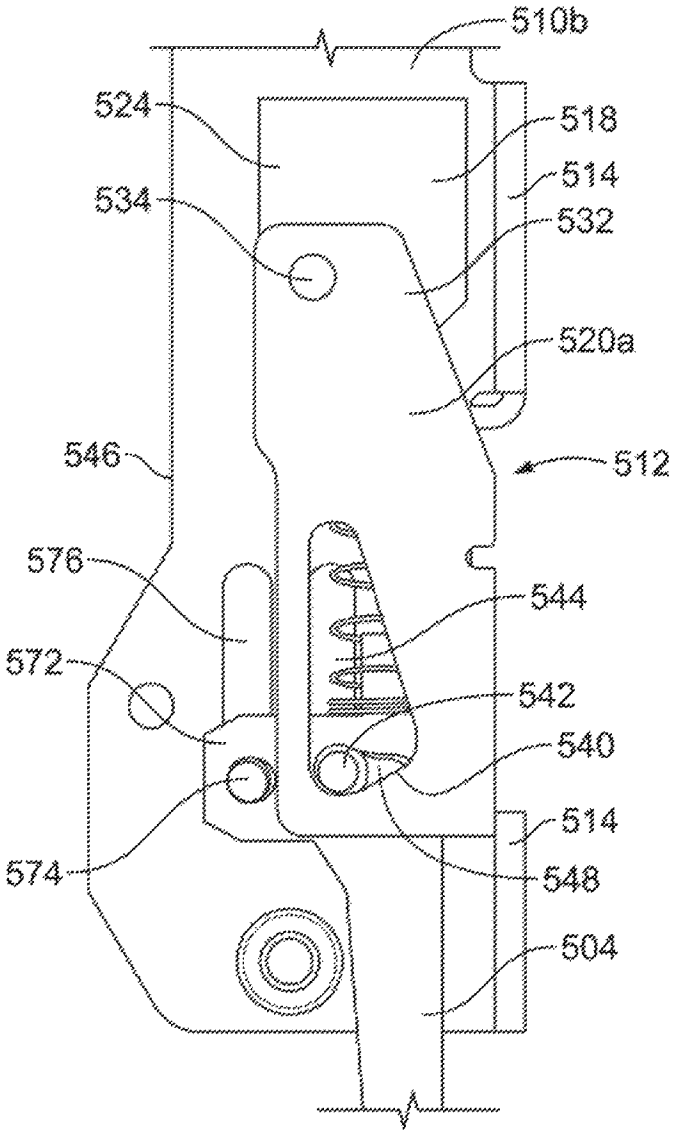
FIGS. 19, 20*a*, and 20*b* illustrate interior and exterior views of the housing of the latch mechanism shown in FIG. 18, with the actuator mechanism, including the latch bolt, at different positions between an extended, locked position and a retracted, unlocked position.
Figure 18:
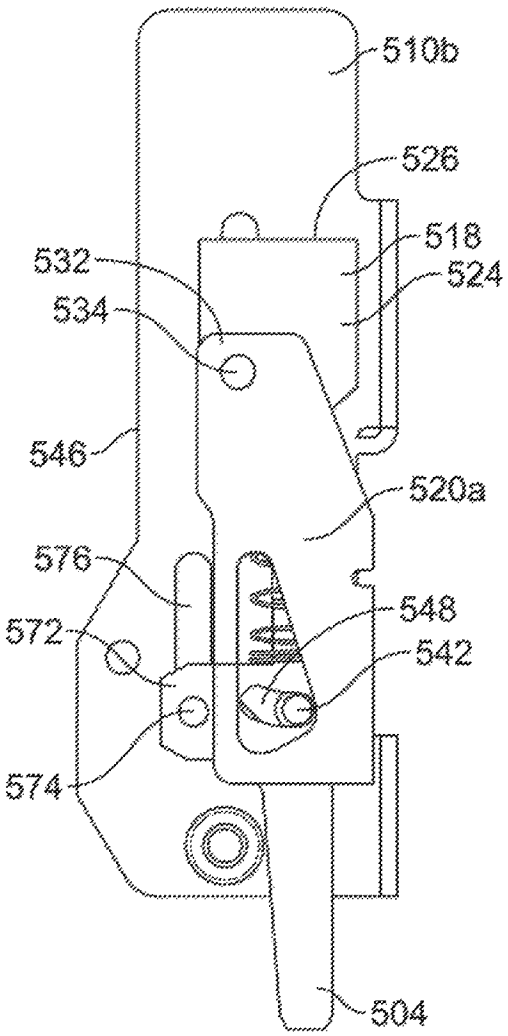
FIG. 18 illustrates a side view within the housing of the latch mechanism shown in FIG. 15*a* with the actuator mechanism, including the latch bolt, in an extended, locked position.
Figure 20B:
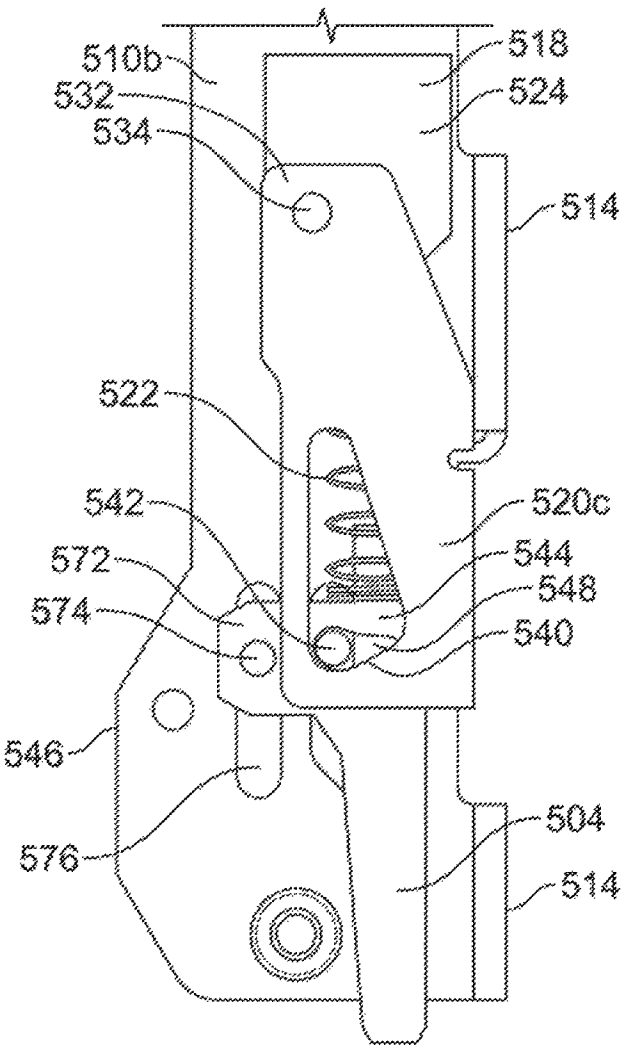
Figure 20A:
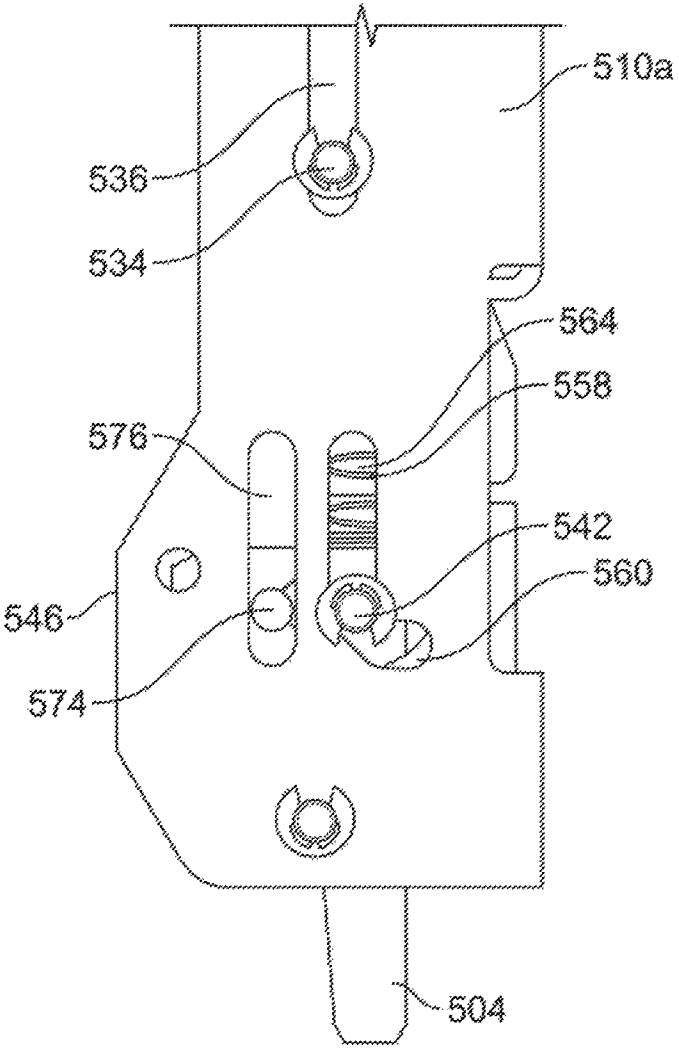
Figure 23:
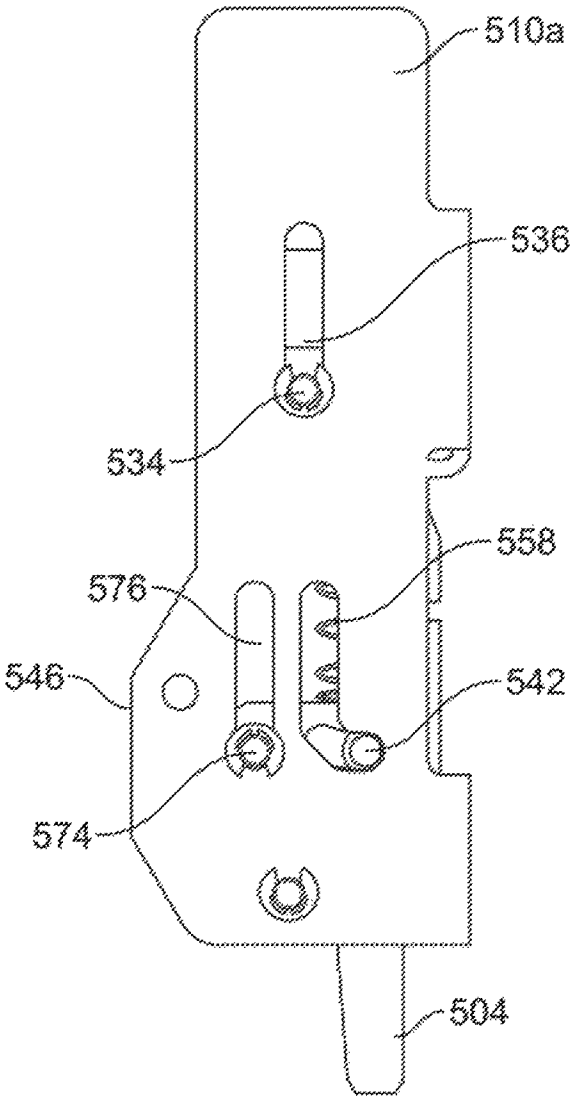
FIG. 23 illustrates a side view of the latch mechanism shown in FIG. 15*a* with the actuator mechanism in the extended, locked position.

As shown in FIG. 16, the actuator mechanism 502 may include a displacement rod or connector 518, a latch bolt 504, a link 520, and a biasing element 522. The displacement rod 518 may include an outer wall 524 having a first end 526 and a second end 528. The first end 526 may be configured for operable connection to a rod or cable 112 of the exit device 100. According to the illustrated embodiment, during generally typical opening of a closed, locked door 102, when the latch bolt 504 is to be displaced from an extended, locked position, as shown for example, in FIGS. 15, 17 and 23, to a retracted, unlocked position, as shown for example in FIGS. 20*b* and 21, activation of the push bar or trim 108 may cause the rod or cable 112 to exert a pulling force on displacement rod 518 that causes the displacement of the displacement rod 518 generally in a vertical direction ("V" direction in FIG. 17). When in the retracted, unlocked position, at least a portion of the latch bolt 504 is positioned so that the latch bolt 504 does not protrude from the latch mechanism 500 in a manner that would prevent the door 102 from being displaced from a closed position to an open position.

The first end 526 of the displacement rod 518 may be connected to the rod or cable 112 in a number of different manners. For example, according to certain embodiments, the displacement rod 518 may be adapted to be secured to the rod or cable 112 using a mechanical connection, including, for example, a bolt, screw, pin, clamp, or threaded connection, among other connections. In the illustrated embodiment, the displacement rod 518 includes a first aperture 530 having an internal thread that is adapted to mate an external thread of, or operably coupled to, the rod or cable 112.

Figure 17:
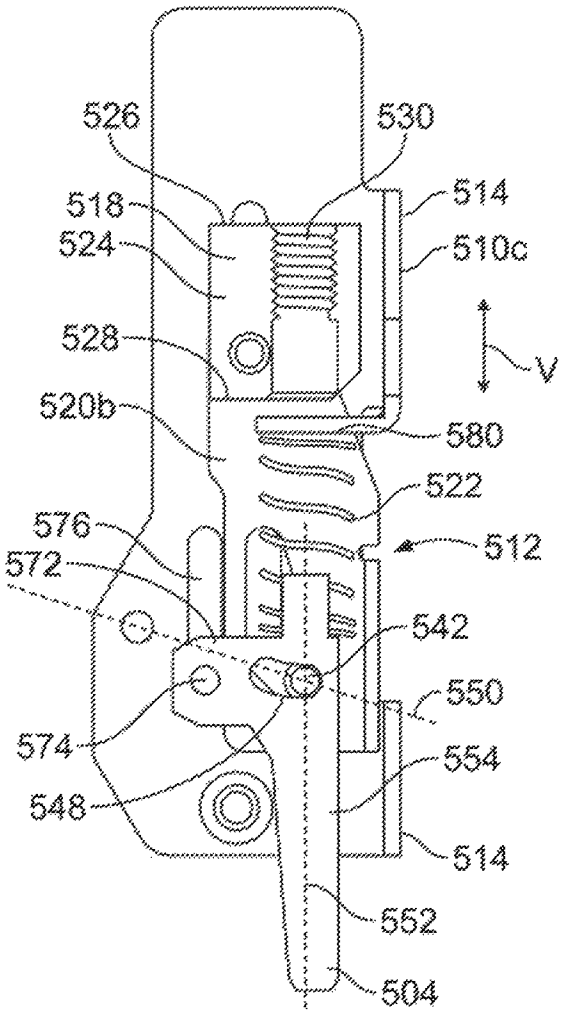
FIG. 17 illustrates a side cross-sectional view of the latch mechanism shown in FIG. 15*a*.
Figure 24:
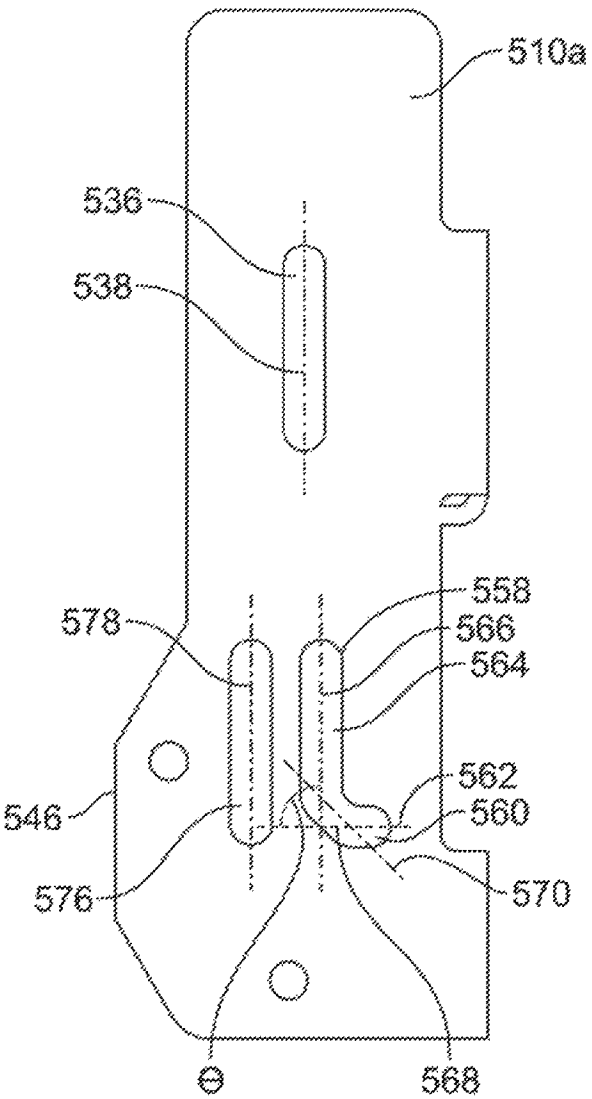
FIG. 24 illustrates a side view of a sidewall of a housing of the latch mechanism shown in FIG. 15*a*.

According to certain embodiments, the link 520 may comprise two links 520*a*, 520*b*, a first end 532 of each of the links 520*a*, 520*b* being coupled to a side of the displacement rod 518, as shown, for example, in FIG. 17. In the illustrated embodiment, one or more link pins 534 may extend or protrude from the displacement rod 518 and into at least a portion of the links 520*a*, 520*b*. According to such an embodiment, the link 520 may be displaced in the same general direction as the displacement rod 518 as the displacement rod 518 moves between its extended, locked position and retracted, unlocked positions. Although the links 520*a*, 520*b* and the displacement rod 518 are shown as separate components that are coupled together by at least the link pin 534, according to other embodiments, the links 520*a*, 520*b* and displacement rod 518 may be part of a monolithic structure. Additionally, as illustrated in FIGS. 15*a* and 15*b*, the link pin 534 may at least extend into a first housing slot 536 in the adjacent first and/or second sidewall 510*a*, 510*b*. As shown in FIG. 24, the first housing slot 536 may have an elongated shape that extends along an axis 538 that is generally parallel to the direction of movement of at least the displacement rod 518 when the displacement rod 518 is displaced between its extended, locked position and retracted, unlocked position.

As shown in FIGS. 15*b*-19 and 20*b*, the links 520*a*, 520*b* may include a cam surface 540 that may be abutted by a cam pin 542. Further, according to certain embodiments, the cam surface 540 may define at least a portion of an outer perimeter of a cam opening 544 in the link 520. The cam surface 540 may be configured to facilitate the displacement of the cam pin 542 along the cam surface 540 in a first direction, such as, for example, toward a first side 546 of the housing 506 as the latch bolt 504 is displaced toward the retracted, unlocked position. For example, according to the illustrated embodiment, the cam surface 540 may have a sloped or descending configuration that at least assists in the cam surface 540 at least influencing the displacement of the cam pin 542 generally in the direction of the first side 546 of the housing 506 when the link 520 is being displaced by the displacement of the displacement rod 518 toward a retracted, unlocked position.

In the illustrated embodiment, the cam pin 542 may extend through the cam opening 544 and into a latch slot 548 in the latch bolt 504. As shown in FIG. 17, the latch slot 548 may have an elongated shape that generally extends along an axis 550 that is angularly offset from a longitudinal axis 552 of a body portion 554 of the latch bolt 504. Additionally, the latch slot 548 may be angled upwardly towards the first side 546 of the housing 506. Further, the cam pin 542 may also extend to and/or through a second housing slot 558 in the first and/or second sidewall 510*a*, 510*b* of the housing 506. According to the illustrated embodiment, the second housing slot 558 may have an "L" or dog-legged shape or configuration. For example, a first portion 560 of the second housing slot 558 may have an elongated shape that extends along a first axis 562, while a second portion 564 of the second housing slot 558 has an elongated shape that extends along a second axis 566, the first axis 562 extending away from the second axis 566 by an angle (θ) that is about 90 degrees. Further, according to the illustrated embodiment, the second axis 566 may be generally parallel to the direction of travel of the displacement rod 518 when the displacement rod 518 is displaced between the extended, locked position and the retracted, unlocked position. Moreover, the second axis 566 of the second portion 564 of the second housing slot 558 may be generally parallel to the axis 538 of the first housing slot 536. Additionally, the second housing slot 558 may include a third portion 568 that provides a transition between the first and second portions 560, 564 of the second housing slot 558. The third portion 568 may extend along a third axis 570 that is not parallel to either the first or second axes 562, 566 of the first or second portions 560, 564. For example, according to certain embodiments, the third axis 570 may be at about a 45 degree angle to the first and/or second axes 562, 566.

Figure 22B:
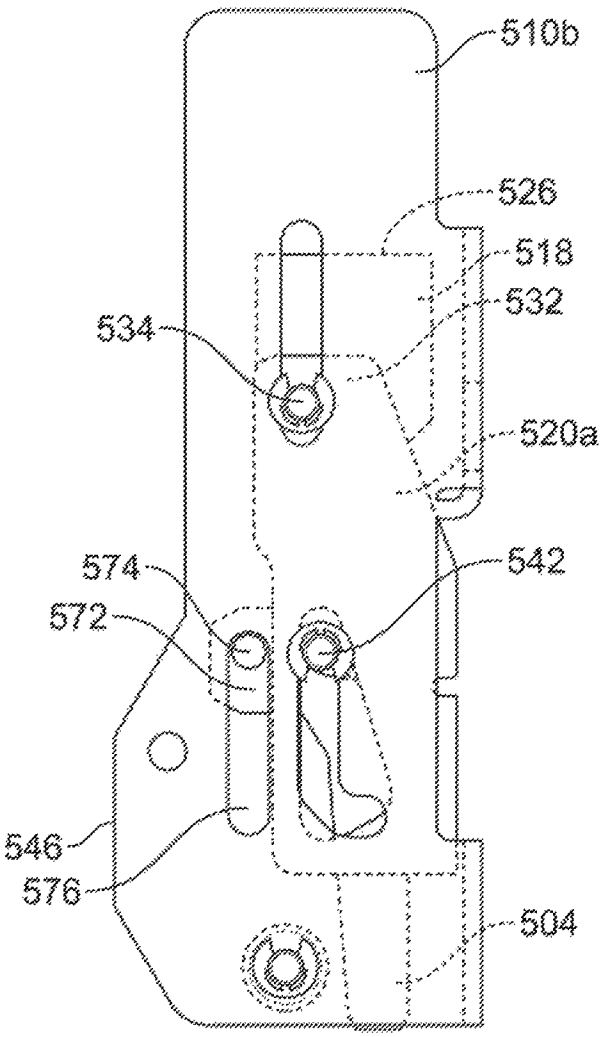
FIGS. 22*a* and 22*b* illustrate a side partial phantom view and a side view, respectively, of the latch mechanism shown in FIG. 15*a* with a portion of the actuator mechanism in the extended, locked position while the latch bolt remains in the retracted, unlocked position.
Figure 22A:
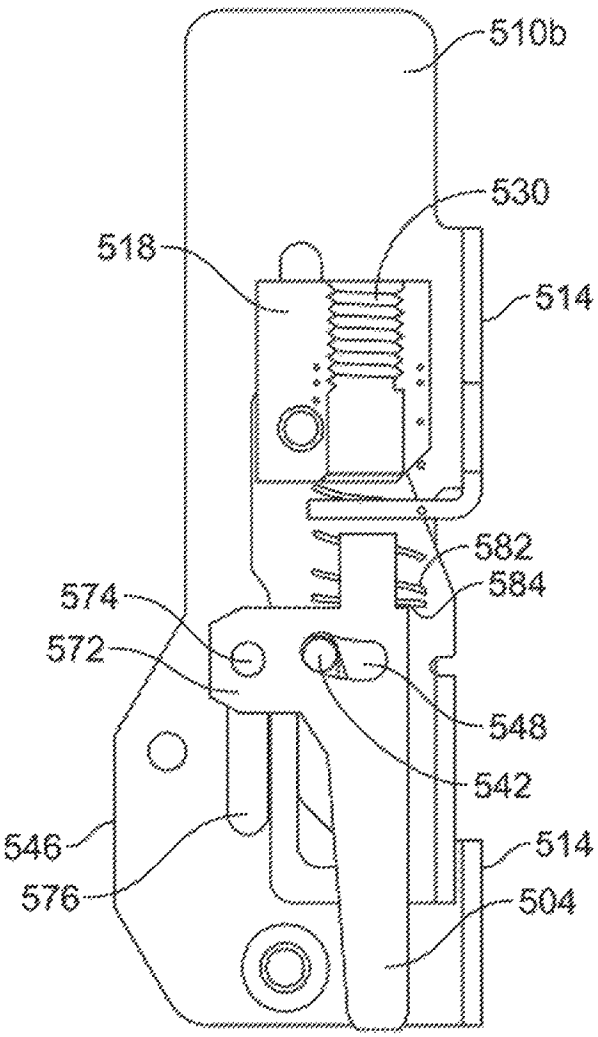

As shown in FIGS. 17 and 22*a*, the latch bolt 504 may include a projection 572 that extends from the body portion 554 of the latch bolt 504. According to the illustrated embodiment, at least a portion of the latch slot 548 may extend into the projection 572. Additionally, the projection 572 may include, or be coupled to, a latch pin 574 that extends into a third housing slot 576. As shown in FIG. 24, the third housing slot 576 may have an elongated shape that extends generally long an axis 578 that is generally parallel to the axis 538 of the first housing slot 536 and the second axis 566 of the second portion 564 of the second housing slot 558. Thus, as the latch bolt 504 is displaced between the extended, locked position and the retracted, unlocked position, the latch pin 574 may be displaced about the third housing slot 576 in a direction that is generally parallel to the direction of the vertical displacement (as indicated by "V" direction in FIG. 17) of the latch bolt 504.

The biasing element 522 is adapted to exert a force upon at least the latch bolt 504 that biases the latch bolt 504 to and/or toward the extended, locked position. According to the illustrated embodiment, a first end 580 of the biasing element 522 may be coupled to the housing 506 at a generally static location. Additionally, a second end 582 of the biasing element 522 may be coupled to, or abut against, a portion of the latch bolt 504. For example, according to the illustrated embodiment in which the biasing element 522 is a spring, at least a portion of the biasing element 522 may extend over at least a portion of the body portion 554 of the latch bolt 504 such that the second end 582 of the biasing element 522 abuts against the projection 572. Further, the latch bolt 504 may include a shoulder region 584 on a side of the latch bolt 504 that is opposite of the side from which the projection 572 extends, and which, in addition to the projection 572, provides a surface against which the second end 582 of the biasing element 522 may also abut.

When the exit device 100 is activated such that the latch bolt 504 is to be displaced from the extended, locked position to the retracted, unlocked position, a rod or cable 112 that is operably connected to the displacement rod 518 may vertically pull or push the displacement rod 518 in a direction away from the latch bolt 504. As the link 520 is coupled to the displacement rod 518 via the link pin 534, or alternatively part of, the displacement of the displacement rod 518 may cause the link 520 to also be displaced with the displacement rod 518 in a generally vertical direction (as indicated by "V" in FIG. 17). Such displacement of the link 520 may cause the cam surface 540 of the link 520 to facilitate, the displacement of the cam pin 542, such as, for example, push the cam pin 542, along the cam surface 540 in a first direction, such as, for example, toward a first side 507 of the housing 506. Additionally, as the cam pin 542 is pushed along the cam surface 540, the cam pin 542 may travel along from the first portion 560 to the third portion 568 of the second housing slot 558, as well as be displaced within the latch slot 548 in the latch bolt 504. Moreover, such displacement of the cam pin 542 along at least the latch slot 548 may at least assist in facilitating the displacement of the latch bolt 504 in a direction that is generally parallel to the direction of displacement of the displacement rod 518. Such vertical displacement of the latch bolt (as indicated by the "V" direction in FIG. 17) may also result in the latch pin 574 being displaced along the third housing slot 576 until the latch bolt 504 reaches the retracted, unlocked position. Additionally, the displacement of the latch bolt 504 toward the retracted, unlocked position, may result in the compression of the biasing element 522.

When the pushing or pulling force provided by the rod or cable 112 of the exit device 100 is released, at least the biasing element 522 may provide a force that biases the latch bolt 504 back toward, and to, the extended, locked position. The displacement rod 518 and other components of the actuator mechanism may therefore begin returning to their extended, locked positions. For example, the link pin 534, cam pin 542, and latch pin 574, may be displaced along their respective openings in the link 520, latch bolt 504, and/or housing 506 until reaching their associated extended, locked positions.

Figure 21:
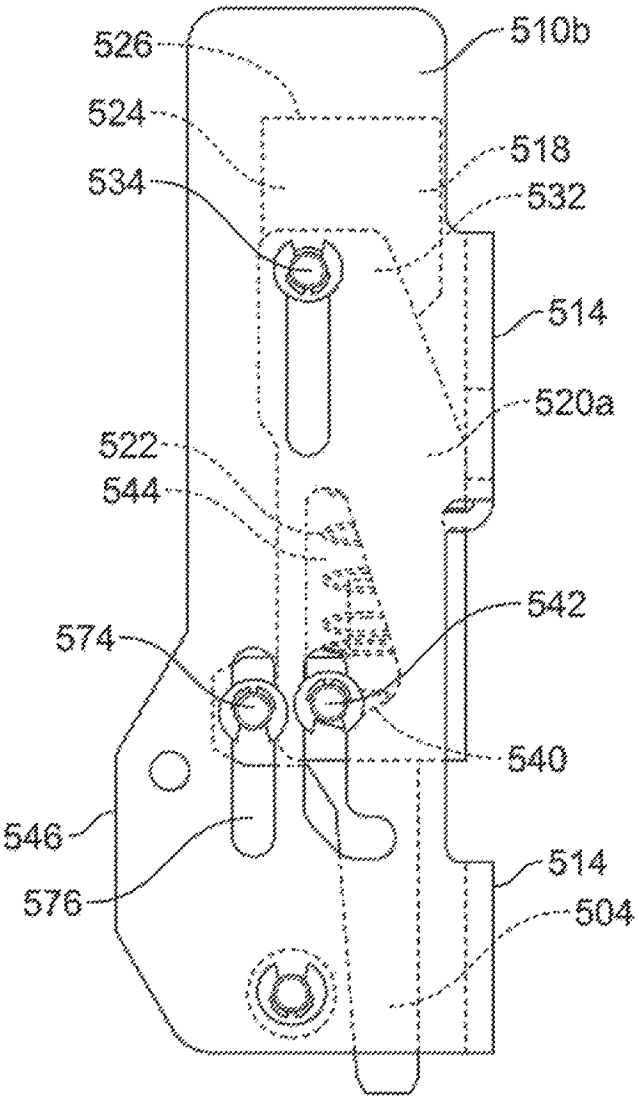
FIG. 21 illustrates a side partial phantom view of the latch mechanism shown in FIG. 15*a* with the actuator mechanism in the retracted, unlocked position.

In certain situations, the latch bolt 504 may remain in the retracted, unlocked position despite the release of the pulling or pushing force that had displaced the displacement rod 518 to the retracted, unlocked position. In such situations, in an effort to prevent another, inter-related latch mechanism from being unable to return its own latch bolt to an extended, locked position, the cam opening 544 in the link 520 may be sized to accommodate the vertical displacement of at least the displacement rod 518 to its extended, locked position while the latch bolt 504 remains in the retracted, unlocked position, as shown, for example, in FIGS. 22*a* and 22*b*. For example, as shown in FIG. 22*b*, the cam opening 544 may have an elongated length in a direction that generally parallel to the direction of displacement of the displacement rod 518 when the displacement rod 518 moves between its extended and retracted positions. Such an elongated configuration of the cam opening 544 may be sized so that the cam opening 546 may accommodate the vertical displacement of the link pin 534 along the first housing slot 536 such that the link pin 534, as well as the associated displacement rod 518 may return to their respective extended, locked positions despite the latch bolt 504 remaining in its retracted, unlocked position. For example, when the actuator mechanism 502 is in the retracted, unlocked position, the link pin 534 is generally positioned within an upper region of the first housing slot 536, as shown in FIG. 21, and is in a lower region of the first housing slot 536 when the actuator mechanism 502 is in the extended, locked position, as shown in FIG. 15*a*. However, according to the illustrated embodiment, the cam opening 544 is sized to allow the link pin 534 to return to the lower region of the first housing slot 536 when the actuator mechanism 502 is to be returned to the extended, locked position, even in the event that the latch bolt 504 fails be return with the remainder of the actuator mechanism 502 to the extended, locked position.

Figure 25:
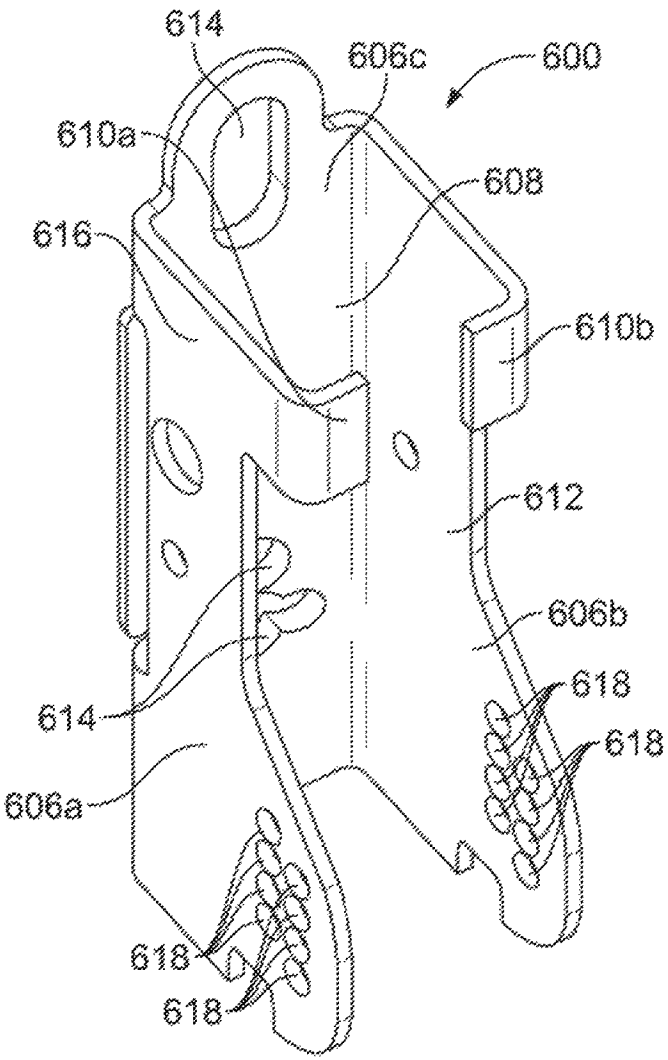
FIG. 25 illustrates a perspective side view of a mounting bracket for adjustably securing a latch mechanism to a door according an embodiment of the present invention.
Figure 27:
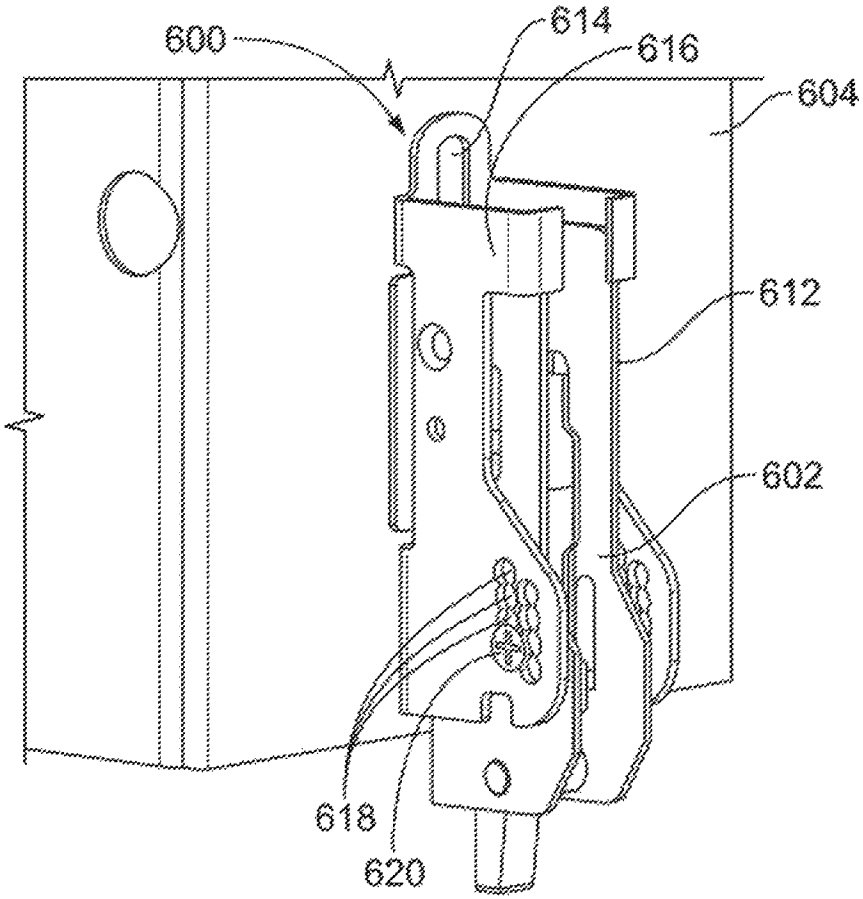
FIG. 27 illustrates a side perspective view of the mounting bracket shown in FIG. 25 secured to a door and with a latch mechanism secured to the mounting bracket at a second position.
Figure 26:
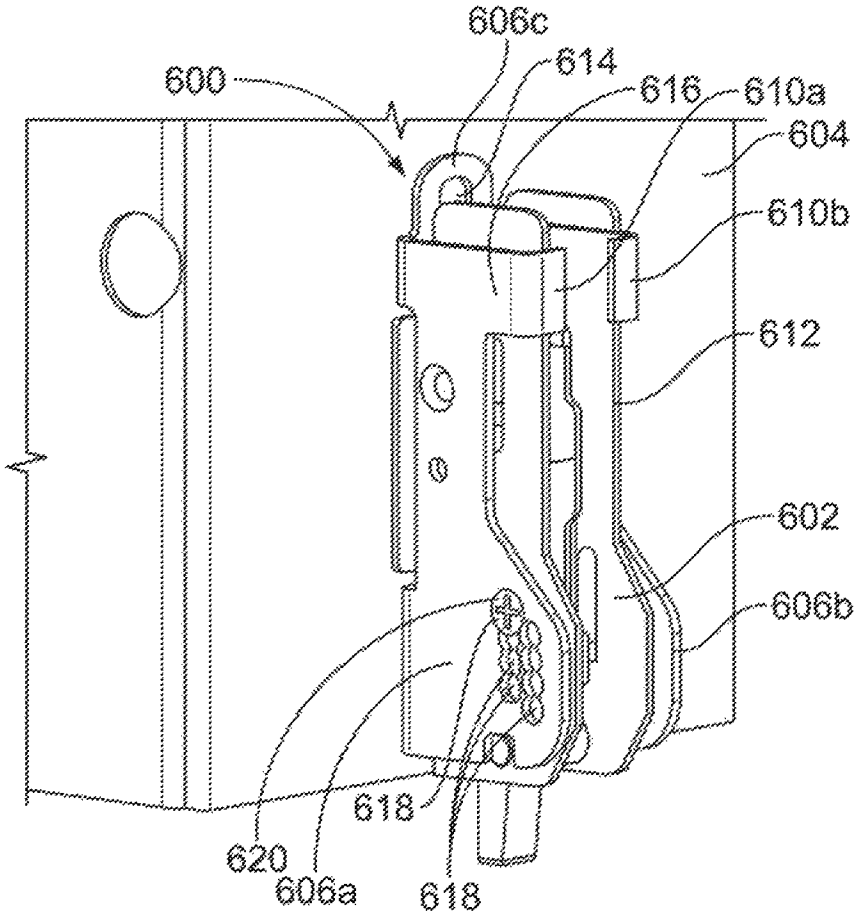
FIG. 26 illustrates a side perspective view of the mounting bracket shown in FIG. 25 secured to a door and with a latch mechanism secured to the mounting bracket at a first position.

FIGS. 25-27 illustrate a mounting bracket 600 for adjustably mounting a variety of different types of latch mechanisms 602 to a door 604. Further the depicted mounting bracket 600 may be adapted to permit adjustments as to the position of latch mechanisms 602 relative to the associated door 604. Additionally, the mounting bracket 600 is adapted to be mounted directly to the door 604 such that the latch mechanism 602 may be directly mounted to the mounting bracket rather than the door 604.

As shown, the mounting bracket 600 includes opposing first and second sidewalls 606*a*, 606*b* that are joined together by at least a rear wall 606*c*. The sidewalls 606*a*, 606*b* and rear wall 606*c* may generally define an inner region 608 of the mounting bracket 600. The inner region 608 of the mounting bracket 600 may be generally sized to receive the placement of at least a portion of the latch mechanism 602 within the mounting bracket 600.

The rear wall 606*c* may be adapted to be secured to the door 604, such as, for example, via one or more mechanical fasteners that may pass through one or more apertures 614 in the rear wall 606*c*. Additionally, front legs 610*a*, 610*b* may extend from a front portion 612 of the mounting bracket 600. For example, in the illustrated embodiment, the legs 610*a*, 610*b* may extend from an upper region 616 of the first and second sidewalls 606*a*, 606*b* and may be configured to retain the latch mechanism 602 in the inner region 608 of the mounting bracket 600.

The first and second sidewalls 606*a*, 606*b* of the mounting bracket 600 may include a plurality of mounting orifices 618 that are adapted to accommodate the passage of a mechanical fastener(s) 620, such as, for example, a screw, bolt, or pin, among other fasteners. The plurality of mounting orifices 618 may be arranged so as to accommodate the different locations of mounting holes on different latch mechanisms 602, thereby increasing the number of latch mechanisms 602 that may be mounted to the door 604 via use of the mounting bracket 600. Additionally, the plurality of mounting orifices 618 may be arranged to improve the precision at which the latch mechanism 602 is positioned relative to the adjacent door frame or floor. Moreover, such mounting orifices 618 may allow for adjustments as to the location at which the latch mechanism 602 is mounted to the mounting bracket 600, such as, for example, at a first, lower position, as shown in FIG. 26, or at a second, higher position, as shown in FIG. 27. Additionally, use of the mounting bracket 600 and the versatility provided by the inclusion of the plurality of mounting orifices 618 may improve the ease of installation for at least retrofit applications.

Various features and advantages of the present invention are set forth in the following claims. Additionally, changes and modifications to the described embodiments described herein will be apparent to those skilled in the art, and such changes and modifications can be made without departing from the spirit and scope of the present invention and without diminishing its intended advantages. While the present invention has been illustrated and described in detail in the drawings and foregoing description, the same is to be considered illustrative and not restrictive in character, it being understood that only selected embodiments have been shown and described and that all changes, equivalents, and modifications that come within the scope of the inventions described herein or defined by the following claims are desired to be protected.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An apparatus, comprising:

a displacement rod structured for displacement between a retracted rod position and an extended rod position;

at least one first link having a first end and an elongate link slot, the first end of the at least one first link pivotally coupled to the displacement rod by a first link pin;

at least one second link having a first end and a second end, the first end of the at least one second link pivotally coupled to the at least one first link by a second link pin extending into and displaceable along a length of the elongate link slot during displacement of the displacement rod; and a latch bolt structured for displacement between an extended position and a retracted position and having a first elongate latch slot, a second elongate latch slot, a latch pin extending into and displaceable along the first elongate latch slot during displacement of the latch bolt, and a static latch pin extending into and displaceable along the second elongate latch slot during displacement of the latch bolt.

2. The apparatus of claim 1, further comprising a biasing element structured to provide a biasing force that biases the position of at least the at least one first link.

3. The apparatus of claim 2, further comprising a housing having a plurality of sidewalls defining an inner region, the inner region sized to receive at least a portion of the latch bolt and at least a portion of the displacement rod, and wherein the positon of the static latch pin is static relative to the housing.

4. The apparatus of claim 3, wherein the housing includes a first housing slot structured to receive the first link pin, the first housing slot extending along an axis arranged parallel to a direction of displacement of the displacement rod as the displacement rod travels between the retracted rod position and the extended rod position.

5. The apparatus of claim 4, wherein the housing includes a second housing slot adapted to receive the second link pin, the second housing slot having a first portion and a second portion, the first portion extending along a first axis, the second portion extending along a second axis that is non-parallel to the first axis.

6. The apparatus of claim 1, wherein the first elongate latch slot extends along an axis that is angularly offset from and arranged non-perpendicular to an axis of the second elongate latch slot.

7. The apparatus of claim 6, further comprising a latch housing having a sidewall defining a slot, wherein the latch pin extends through the slot in the latch housing, and wherein the slot extends along an axis arranged perpendicular to the axis of the first latch slot.

8. The apparatus of claim 1, wherein the elongate link slot extends along a link axis, the elongate link slot structured to accommodate displacement of the second link pin at least when the displacement rod is displaced from the extended rod position to the retracted rod position while the latch bolt remains in the retracted position.

9. An apparatus, comprising:

a displacement rod structured for displacement between a retracted rod position and an extended rod position;

a first link pivotally coupled to the displacement rod;

a second link pivotally coupled to the first link; and a latch bolt configured for displacement between an extended position and a retracted position, the latch bolt having a first elongate latch slot, a second elongate latch slot, a latch pin extending into and displaceable along a length of the first elongate latch slot during displacement of the latch bolt, and a static latch pin extending into and displaceable along a length of the second elongate latch slot during displacement of the latch bolt.

10. The apparatus of claim 9, wherein the first link defines an elongate link slot; and wherein the second link is pivotally coupled to the first link by a link pin extending into and displaceable along the elongate link slot.

11. The apparatus of claim 10, wherein the elongate link slot extends along a link axis, the link slot structured to accommodate displacement of the link pin at least when the displacement rod is displaced from the extended rod position to the retracted rod position while the latch bolt remains in the retracted position.

12. The apparatus of claim 9, further comprising a biasing element structured to provide a biasing force that biases the position of the first link.

13. The apparatus of claim 9, further comprising a housing having a plurality of sidewalls defining an inner region sized to receive at least a portion of the latch bolt and at least a portion of the displacement rod, and wherein the positon of the static latch pin is static relative to the housing.

14. The apparatus of claim 13, wherein the housing includes a first housing slot structured to receive a first link pin that pivotally couples the first link to the displacement rod, the first housing slot extending along an axis arranged parallel to a direction of displacement of the displacement rod as the displacement rod travels between the retracted rod position and the extended rod position; and wherein the housing includes a second housing slot adapted to receive a second link pin that pivotally couples the second link to the first link, the second housing slot having a first portion and a second portion, the first portion extending along a first axis, the second portion extending along a second axis that is non-parallel to the first axis.

15. The apparatus of claim 9, wherein the first elongate latch slot extends along an axis that is angularly offset from and arranged non-perpendicular to an axis of the second elongate latch slot.

16. An apparatus, comprising:

a displacement rod structured for displacement between a retracted rod position and an extended rod position;

at least one first link having a first end and an elongate link slot, the first end of the at least one first link pivotally coupled to the displacement rod by a first link pin;

at least one second link having a first end and a second end, the first end of the at least one second link pivotally coupled to the at least one first link by a second link pin extending into and displaceable along a length of the elongate link slot during displacement of the displacement rod; and a latch bolt pivotally coupled to the second end of the at least one second link by a latch pin, the latch bolt structured for displacement between an extended position and a retracted position, wherein the latch bolt has an elongate latch slot with the latch pin extending into and displaceable along a length of the elongate latch slot during displacement of the latch bolt between the extended and retracted positons.

17. The apparatus of claim 16, wherein the latch bolt has a second elongate latch slot and a static latch pin extending into and displaceable along a length of the second elongate latch slot during the displacement of the latch bolt between the extended and retracted positons.

18. The apparatus of claim 17, wherein the first elongate latch slot extends along an axis that is angularly offset from and arranged non-perpendicular to an axis of the second elongate latch slot.

19. The apparatus of claim 17, further comprising a latch housing having a plurality of sidewalls defining an inner region, the inner region sized to receive at least a portion of the latch bolt and at least a portion of the displacement rod, and wherein the positon of the static latch pin is static relative to the housing.

20. The apparatus of claim 19, wherein the latch housing includes:

a first housing slot structured to receive the first link pin, the first housing slot extending along an axis arranged parallel to a direction of displacement of the displacement rod as the displacement rod travels between the retracted rod position and the extended rod position; and a second housing slot adapted to receive the second link pin, the second housing slot having a first portion and a second portion, the first portion extending along a first axis, the second portion extending along a second axis that is non-parallel to the first axis.

* * * * *